US010753201B2

(12) United States Patent
Logan et al.

(10) Patent No.: US 10,753,201 B2
(45) **Date of Patent: *Aug. 25, 2020**

(54) MUD PULSE TELEMETRY APPARATUS WITH A PRESSURE TRANSDUCER AND METHOD OF OPERATING SAME

(71) Applicant: Evolution Engineering Inc., Calgary (CA)

(72) Inventors: Aaron W. Logan, Calgary (CA); Jili Liu, Calgary (CA); David A. Switzer, Calgary (CA); Justin C. Logan, Calgary (CA)

( * ) Notice: Subject to any disclaimer, the term of this patent is extended or adjusted under 35 U.S.C. 154(b) by 318 days.

This patent is subject to a terminal disclaimer.

(21) Appl. No.: 15/628,473

(22) Filed: Jun. 20, 2017

(65) Prior Publication Data

US 2017/0284194 A1 Oct. 5, 2017

Related U.S. Application Data

(63) Continuation-in-part of application No. 14/652,445, filed as application No. PCT/CA2013/050982 on Dec. 17, 2013, now Pat. No. 9,714,569.

(Continued)

(51) Int. Cl.

| | |
|---|---|
| ***E21B 47/18*** | (2012.01) |
| ***E21B 47/06*** | (2012.01) |
| *E21B 47/01* | (2012.01) |

(52) U.S. Cl.

CPC ..... *E21B 47/18* (2013.01); *E21B 47/06* (2013.01); *E21B 47/182* (2013.01); *E21B 47/011* (2013.01)

(58) Field of Classification Search

CPC ..... E21B 47/18; E21B 47/182; E21B 47/187; E21B 47/06; E21B 47/011; G01V 11/002

See application file for complete search history.

(56) References Cited

U.S. PATENT DOCUMENTS

| | | | |
|---|---|---|---|
| 3,302,457 | A | 2/1967 | Mayes |
| 3,309,656 | A | 3/1967 | Godbey |

(Continued)

FOREIGN PATENT DOCUMENTS

| | | | |
|---|---|---|---|
| CA | 1 228 909 | A | 11/1987 |
| CA | 1 229 998 | A | 12/1987 |

(Continued)

*Primary Examiner* — Ian J Lobo

(74) *Attorney, Agent, or Firm* — Seed IP Law Group LLP

(57) ABSTRACT

A pressure measurement apparatus for a downhole measurement-while-drilling tool comprises a feed through connector and a pressure transducer. The feed through connector comprises a body with a first end and an opposite second end, at least one electrical interconnection extending axially through the body and out of the first and second ends, and a pressure transducer receptacle in the first end and a communications bore extending from the receptacle to the second end. The pressure transducer is seated in the receptacle such that a pressure at the first end can be measured, and comprises at least one electrical contact that extends from the pressure transducer through the communication bore and out of the second end. The pressure transducer can take pressure measurements used to predict wear of a primary seal in a motor subassembly of the tool, detect a pressure-related battery failure event, and control operation of a dual pulse height fluid pressure pulse generator.

10 Claims, 18 Drawing Sheets

Related U.S. Application Data

(60) Provisional application No. 61/738,285, filed on Dec. 17, 2012.

(56) References Cited

U.S. PATENT DOCUMENTS

| | | | |
|---|---|---|---|
| 3,764,968 | A | 10/1973 | Anderson |
| 3,958,217 | A | 5/1976 | Spinnler |
| 3,982,224 | A | 9/1976 | Patton |
| 4,351,037 | A | 9/1982 | Scherbatskoy |
| 4,641,289 | A | 2/1987 | Jürgens |
| 4,734,892 | A | 3/1988 | Kotlyar |
| 4,771,408 | A | 9/1988 | Kotlyar |
| 4,785,300 | A | 11/1988 | Chin et al. |
| 4,830,122 | A | 5/1989 | Walter |
| 4,847,815 | A | 7/1989 | Malone |
| 4,914,637 | A | 4/1990 | Goodsman |
| 4,953,595 | A | 9/1990 | Kotlyar |
| 4,979,577 | A | 12/1990 | Walter |
| 5,073,877 | A | 12/1991 | Jeter |
| 5,079,750 | A | 1/1992 | Scherbatskoy |
| 5,182,730 | A | 1/1993 | Scherbatskoy |
| 5,182,731 | A | 1/1993 | Hoelscher et al. |
| 5,215,152 | A | 6/1993 | Duckworth |
| 5,237,540 | A | 8/1993 | Malone |
| 5,249,161 | A | 9/1993 | Jones et al. |
| 5,316,610 | A | 5/1994 | Tamaki et al. |
| 5,390,153 | A | 2/1995 | Scherbatskoy |
| 5,396,965 | A | 3/1995 | Hall et al. |
| 5,583,827 | A | 12/1996 | Chin |
| 5,586,083 | A | 12/1996 | Chin et al. |
| 5,586,084 | A | 12/1996 | Barron et al. |
| 5,636,178 | A | 6/1997 | Ritter |
| 5,740,126 | A | 4/1998 | Chin et al. |
| 5,740,127 | A | 4/1998 | Van Steenwyk et al. |
| 5,787,052 | A | 7/1998 | Gardner et al. |
| 5,950,736 | A | 9/1999 | Goldstein |
| 6,016,288 | A | 1/2000 | Frith |
| 6,097,310 | A | 8/2000 | Harrell et al. |
| 6,105,690 | A | 8/2000 | Biglin, Jr. et al. |
| 6,219,301 | B1 | 4/2001 | Moriarty |
| 6,414,905 | B1 | 7/2002 | Owens et al. |
| 6,453,747 | B1 | 9/2002 | Weise et al. |
| 6,469,637 | B1 | 10/2002 | Seyler et al. |
| 6,626,253 | B2 | 9/2003 | Hahn et al. |
| 6,714,138 | B1 | 3/2004 | Turner et al. |
| 6,750,783 | B2 | 6/2004 | Rodney |
| 6,850,463 | B2 | 2/2005 | Winnacker |
| 6,867,706 | B2 | 3/2005 | Collette |
| 6,898,150 | B2 | 5/2005 | Hahn et al. |
| 6,932,154 | B2 | 8/2005 | Zillinger |
| 6,970,398 | B2 | 11/2005 | Lavrut et al. |
| 6,975,244 | B2 | 12/2005 | Hahn et al. |
| 7,138,929 | B2 | 11/2006 | Jeffryes et al. |
| 7,145,834 | B1 | 12/2006 | Jeter |
| 7,180,826 | B2 | 2/2007 | Kusko et al. |
| 7,230,880 | B2 | 6/2007 | Lehr |
| 7,250,873 | B2 | 7/2007 | Hahn et al. |
| 7,280,432 | B2 | 10/2007 | Hahn et al. |
| 7,319,638 | B2 | 1/2008 | Collette |
| 7,327,634 | B2 | 2/2008 | Perry et al. |
| 7,330,397 | B2 | 2/2008 | Ganesan et al. |
| 7,367,229 | B2 | 5/2008 | Engstrom |
| 7,400,262 | B2 | 7/2008 | Chemali et al. |
| 7,405,998 | B2 | 7/2008 | Webb et al. |
| 7,417,920 | B2 | 8/2008 | Hahn et al. |
| 7,468,679 | B2 | 12/2008 | Feluch |
| 7,552,761 | B2 | 6/2009 | Moriarty |
| 7,564,741 | B2 | 7/2009 | Pratt et al. |
| 7,719,439 | B2 | 5/2010 | Pratt et al. |
| 7,735,579 | B2 | 6/2010 | Gopalan et al. |
| 7,808,859 | B2 | 10/2010 | Hahn et al. |
| 7,839,719 | B2 | 11/2010 | Dopf et al. |
| 7,881,155 | B2 | 2/2011 | Close |
| 8,151,905 | B2 | 4/2012 | Song |
| 8,174,929 | B2 | 5/2012 | Camwell et al. |
| 8,203,908 | B2 | 6/2012 | Pratt et al. |
| 8,251,160 | B2 | 8/2012 | Gopalan et al. |
| 8,364,406 | B2 | 1/2013 | Gleitman |
| 9,714,569 | B2 * | 7/2017 | Logan ..... E21B 47/06 |
| 2005/0200498 | A1 | 9/2005 | Gleitman |
| 2009/0038851 | A1 | 2/2009 | Camwell et al. |
| 2009/0280912 | A1 | 11/2009 | Buchanan et al. |
| 2010/0212963 | A1 | 8/2010 | Gopalan et al. |
| 2011/0005835 | A1 | 1/2011 | Li |
| 2011/0168445 | A1 | 7/2011 | Patwa et al. |
| 2011/0169655 | A1 | 7/2011 | Close et al. |
| 2012/0085583 | A1 | 4/2012 | Logan et al. |
| 2012/0127829 | A1 | 5/2012 | Sitka |
| 2012/0195442 | A1 | 8/2012 | Villemoes et al. |

FOREIGN PATENT DOCUMENTS

| | | | |
|---|---|---|---|
| CA | 2 506 808 | C | 10/2010 |
| CA | 2 551 316 | C | 1/2012 |
| CA | 2 855 940 | A1 | 6/2013 |
| GB | 2457175 | B | 5/2011 |
| WO | 94/05893 | A1 | 3/1994 |
| WO | 2005/084281 | A2 | 9/2005 |
| WO | 2006/130606 | A2 | 12/2006 |
| WO | 2007/033126 | A2 | 3/2007 |
| WO | 2009/033146 | A2 | 3/2009 |
| WO | 2010/138961 | A2 | 12/2010 |
| WO | 2012/027245 | A1 | 3/2012 |
| WO | 2012/027633 | A2 | 3/2012 |
| WO | 2012/130936 | A1 | 10/2012 |
| WO | 2012/145637 | A2 | 10/2012 |
| WO | 2014/071514 | A1 | 5/2014 |

* cited by examiner

MUD PULSE TELEMETRY APPARATUS WITH A PRESSURE TRANSDUCER AND METHOD OF OPERATING SAME

FIELD

This invention relates generally to downhole drilling, such as measurement-while-drilling (MWD), including mud pulse telemetry apparatuses having a pressure transducer, and methods of operating such apparatuses.

BACKGROUND

The recovery of hydrocarbons from subterranean zones relies on the process of drilling wellbores. The process includes drilling equipment situated at surface, and a drill string extending from the surface equipment to the formation or subterranean zone of interest. The drill string can extend thousands of feet or meters below the surface. The terminal end of the drill string includes a drill bit for drilling (or extending) the wellbore. In addition to this conventional drilling equipment, the system also relies on some sort of drilling fluid, in most cases a drilling "mud" which is pumped through the inside of the pipe, which cools and lubricates the drill bit and then exits out of the drill bit and carries rock cuttings back to surface. The mud also helps control bottom hole pressure and prevent hydrocarbon influx from the formation into the wellbore, which can potentially cause a blow out at surface.

Directional drilling is the process of steering a well away from vertical to intersect a target endpoint or follow a prescribed path. At the terminal end of the drill string is a bottom-hole-assembly ("BHA") which comprises 1) a drill bit; 2) a steerable downhole mud motor of rotary steerable system; 3) sensors of survey equipment (Logging While Drilling ("LWD") and/or Measurement-while-drilling (MWD)) to evaluate downhole conditions as well depth progresses; 4) equipment for telemetry of data to surface; and 5) other control mechanisms such as stabilizers or heavy weight drill collars. The BHA is conveyed into the wellbore by a metallic tubular.

As an example of a potential drilling activity, MWD equipment is used to provide downhole sensor and status information to surface in a near real-time mode while drilling. This information is used by the rig crew to make decisions about controlling and steering the well to optimize the drilling speed and trajectory based on numerous factors, including lease boundaries, locations of existing wells, formation properties, and hydrocarbon size and location. This can include making intentional deviations from an originally-planned wellbore path as necessary based on the information gathered from the downhole sensors during the drilling process. The ability to obtain real time data during MWD allows for a relatively more economical and more efficient drilling operation.

Known MWD tools contain essentially the same sensor package to survey the well bore but the data may be sent back to surface by various telemetry methods. Such telemetry methods include but are not limited to the use of hardwired drill pipe, acoustic telemetry, use of fibre optic cable, Mud Pulse (MP) telemetry and Electromagnetic (EM) telemetry. The sensors are usually located in an electronics probe or instrumentation assembly contained in a cylindrical cover or housing, located near the drill bit.

Mud Pulse telemetry involves creating pressure waves in the drill mud circulating inside the drill string. Mud is circulated from surface to downhole using positive displacement pumps. The resulting flow rate of mud is typically constant. The pressure pulses are achieved by changing the flow area and/or path of the drilling fluid as it passes the MWD tool in a timed, coded sequence, thereby creating pressure differentials in the drilling fluid. The pressure differentials or pulses may be either negative pulse or positive pulses. Valves that open and close a bypass stream from inside the drill pipe to the wellbore annulus create a negative pressure pulse. All negative pulsing valves need a high differential pressure below the valve to create a sufficient pressure drop when the valve is open, but this results in the negative valves being more prone to washing. With each actuation, the valve hits against the valve seat and needs to ensure it completely closes the bypass; the impact can lead to mechanical and abrasive wear and failure. Valves that use a controlled restriction within the circulating mud stream create a positive pressure pulse. Some valves are hydraulically powered to reduce the required actuation power typically resulting in a main valve indirectly operated by a pilot valve. The pilot valve closes a flow restriction which actuates the main valve to create a pressure drop. Pulse frequency is typically governed by pulse generator motor speed changes. The pulse generator motor requires electrical connectivity with the other elements of the MWD probe.

In typical MWD tools, as well as other downhole tools, there are several electrical connections in the tools. Those skilled in the art will be familiar with the different types of electrical connectors commercially available for MWD and other downhole tools. The electrical connectors serve to electrically and/or communicatively couple two or more electrical devices together. The electrical connectors can vary from simple single-pin to complex multi-pin configurations and for downhole use should maintain stability and mechanical strength under downhole conditions. In many cases, electrical connections between components of a tool are configured such that a wire harness (electrical wires in bundle or pigtail) is engaged within the core of the tool, anchored at two ends with plug in connectors. By combining many wires and cables into such a harness, it can provide more security against the adverse effects of vibrations, abrasions, and moisture and reduce the risk of a short. In assembly, the wire harness can have considerable leeway within the bore of the tool and this free space allows the wires to flex, bend and vibrate as they are not secured throughout their length. Over time, the wire harnesses experience torsional and flexural fatigue which can jeopardize the function of the electrical connections. In many cases, a "snubber assembly" is incorporated in the transition between sections of tool where the electrical connectors are placed to assist in reduction or mitigation of the shock and vibration the electrical wire harness is subject to. Snubber devices in general are rubber or metal devices used to control the movement of electronic and electromechanical equipment during abnormal dynamic conditions and typical allow for free movement of a component during normal operation, but dampen shock to the component in an abnormal condition. In addition, centralizers are typically placed around the probe housing where the wire harnesses are contained within, to try to dampen some of the vibration. In downhole environments such as for directional drilling with increased temperature, shock and vibration there are still considerable failures associated with the looseness of the wire harness within the sub-assemblies. There is a high degree of failure of both the coupling devices as well as the electrical connectors so these must be routinely replaced in the downhole tools.

Typically in MWD probes which carry out mud pulse telemetry, measurement of pressure is important for optimizing drilling parameters. Some solutions have targeted the pressure transducer placement within its own separate probe; the probe tends to contain an intricate wire harness but still allows for fluid flow for data telemetry. Sometimes the transducer is exposed to the drilling fluid, which can cause erosive or corrosive failure of the transducer.

There remains a need for appropriate placement and reliable protection of downhole pressure transducers since accurate measurement of pressure in the localized downhole environment is important for efficient drilling.

SUMMARY

According to one aspect of the invention, there is provided a pressure measurement apparatus for a downhole measurement-while-drilling tool comprising a feed through connector and a pressure transducer. The feed through connector comprises a body with a first end and an opposite second end, at least one electrical interconnection extending axially through the body and out of the first and second ends, and a pressure transducer receptacle in the first end and a communications bore extending from the receptacle to the second end. The pressure transducer is seated in the receptacle such that a pressure at the first end can be measured, and comprises at least one electrical contact that extends from the pressure transducer through the communication bore and out of the second end. A receptacle seal can be provided which extends between the pressure transducer and receptacle and establishes a fluid seal therebetween. The pressure transducer can be removably mounted in the receptacle in which case a retention clip can be provided which is removably mounted in the receptacle to secure the pressure transducer in place when seated in the receptacle. The pressure transducer can take pressure measurements used to predict wear of a primary seal in a motor subassembly of the tool, detect a pressure-related battery failure event, and control operation of a dual pulse height fluid pressure pulse generator.

The pressure measurement apparatus can be part of a fluid pressure pulse telemetry tool. This tool also comprises a fluid pressure pulse generator, a motor subassembly, and an electronics subassembly. The motor subassembly comprises a motor, a pulse generator motor housing that houses the motor, and a driveshaft extending from the motor out of the pulse generator motor housing and coupling with the pressure pulse generator. The electronics subassembly is coupled to the motor subassembly and comprises electronics equipment and an electronics housing that houses the electronics equipment. The feed through connector of the pressure measurement apparatus is located between the motor subassembly and electronics subassembly such that a fluid seal is established therebetween, the interconnection is electrically coupled to the electronics equipment and the motor, and the pressure transducer faces the motor subassembly and is communicative with the electronics equipment.

The pulse generator motor housing can further comprise an end with an annular shoulder in which the pressure measurement apparatus is seated. A feed through seal can be provided which extends between the feed through connector body and the annular shoulder such that a fluid seal is established therebetween. The pressure measurement apparatus can further comprise an annular flange extending around the feed through connector body and have at least one flange bore for receiving a fastener therethrough. The pulse generator motor housing can further comprise an end with a rim configured to mate with the flange, and at least one rim bore configured to align with the flange bore to receive the fastener such that the pressure measurement apparatus is fastened to the pulse generator motor housing. An annular seal can be located between the flange and the rim such that a fluid seal is established therebetween. Additionally, the feed through connector body can be provided with at least one open channel aligned with the flange bore such that the fastener can extend along the channel and through the flange bore.

Alternatively, a collet can be provided comprising inner threads and an annular shoulder extending around its inner surface. The pressure measurement apparatus in such case further comprises an annular flange extending around the feed through connector body and which contacts the annular shoulder to seat the pressure measurement apparatus in the collet. An end of the fluid generator motor housing comprises external threads that threadingly mate with the inner threads of the collet such that the pressure measurement apparatus is secured relative to the end of the fluid generator motor housing.

According to another aspect of the invention, the pressure measurement apparatus can be part of the electronics subassembly for a downhole measurement-while-drilling tool and be used to detect a battery failure. The electronics subassembly in this aspect also comprises an electronics housing, a battery pack, and electronics equipment. The pressure measurement apparatus is mounted inside the electronics housing such that a first compartment and a second compartment are defined inside the electronics housing on either side of the pressure measurement apparatus, and wherein the pressure transducer faces the first compartment to measure a pressure in the first compartment. The battery pack is located in the first compartment and is electrically coupled to the electrical interconnection. The electronics equipment is located in the second compartment and is electrically coupled to the electrical interconnection and the pressure transducer contact. The electronics equipment includes a controller and a memory having program code executable by the controller to perform a method comprising: reading pressure measurements from the pressure transducer, determining whether the read pressure measurements exceed a threshold component failure pressure, and initiating a component failure action when the measured pressure exceeds the threshold component failure pressure. The component failure action can comprise logging a component failure flag in the memory, and/or electrically decoupling the battery pack from the electronics equipment, and/or sending a visual or audio indication of a failure event.

According to another aspect of the invention, the pressure measurement apparatus can be part of a pulse generator motor subassembly for a downhole measurement-while-drilling tool and be used to predict wear of a primary seal in the pulse generator motor subassembly. The pulse generator motor subassembly in this aspect also comprises a housing, a fluid pressure pulse generator motor, the primary seal, and lubrication liquid. The fluid pressure pulse generator motor is located inside the housing and comprises a driveshaft extending out of a driveshaft end of the housing; the driveshaft is for coupling to a rotor of a fluid pressure pulse generator. The primary seal provides a fluid seal between the driveshaft and the housing. The pressure measurement apparatus is mounted in the housing such that it is spaced from the driveshaft end and such that the pressure transducer faces the inside of the housing. The lubrication liquid is fluidly sealed inside the housing by the pulse generator motor housing, primary seal and feed through connector of the pressure measurement device. Electronics equipment is electrically communicative with the pressure transducer, and comprises a controller and a memory having program code executable by the controller to perform a method comprising: reading a pressure measurement from the pressure transducer indicating the pressure of the lubrication liquid, determining whether the read pressure measurement falls below a threshold pressure value, and logging a unique flag in the memory when the read pressure measurement falls below the threshold pressure value. The memory can further comprise program code executable by the controller to transmit a replace seal signal and/or deactivate one or more operations of the measurement-while-drilling tool when the read pressure measurement falls below the threshold pressure value.

According to another aspect of the invention, there is provided a fluid pressure pulse telemetry apparatus comprising: a fluid pressure pulse generator, a motor subassembly, a pressure transducer, and an electronics subassembly comprising a memory with program code for operating the pulse generator between a low amplitude pulse mode and a high amplitude pulse mode. The fluid pressure pulse generator is operable to flow a drilling fluid in a full flow configuration to produce no pressure pulse, a reduced flow configuration to produce a high amplitude pressure pulse and an intermediate flow configuration to produce a low amplitude pressure pulse. The motor subassembly comprises a pulse generator motor, a pulse generator motor housing that houses the motor, and a driveshaft which extends from the motor out of the housing and couples with the pulse generator. The pressure transducer is positioned to measure a pressure of the drilling fluid flowing by the pulse generator. The electronics subassembly comprises: a controller communicative with the pressure transducer to read pressure measurements therefrom and with the motor to control operation of the pulse generator. The memory has a program code stored thereon and which is executable by the controller to perform the following method: operating the pulse generator to produce the no pressure pulse, the high amplitude pressure pulse and the low amplitude pressure pulse and reading the pressures of the no pressure pulse, high amplitude pressure pulse and low amplitude pressure pulse from the pressure transducer; determining an amplitude of the high amplitude pressure pulse and an amplitude of the low amplitude pressure pulse from the measured pressures; comparing the determined amplitudes to a low amplitude reference pressure and a high amplitude reference pressure; and operating the pulse generator between the full and intermediate flow configurations in the low amplitude pulse mode to transmit a telemetry signal to surface only when the determined amplitude of the low amplitude pressure pulse is above the low amplitude reference pressure; or, operating the pulse generator between the full and reduced flow configurations in the high amplitude pulse mode to transmit a telemetry signal to surface only when the determined amplitude of the high amplitude pressure pulse is below the high amplitude reference pressure.

The memory can further comprise program code executable by the controller to operate the pulse generator in the low amplitude pulse mode only when the determined amplitude of the low amplitude pressure pulse is below the high amplitude reference pressure. The memory can also further comprise program code executable by the controller to operate the pulse generator in the high amplitude pulse mode only when the determined amplitude of the high amplitude pressure pulse is above the low amplitude reference pressure.

The memory can further comprise program code executable by the controller to operate in the intermediate flow configuration for a selected default time period during the low amplitude pulse mode, measure the pressure and determine the amplitude of the low amplitude pressure pulse during the low amplitude pulse mode, and increase the amplitude of the low amplitude pressure pulse by operating the pulse generator in the intermediate flow configuration for a time period longer than the default time period when the determined amplitude of the low amplitude pressure pulse is below the low amplitude reference pressure.

The memory can further comprise program code executable by the controller to operate in the reduced flow configuration for a selected default time period during the high amplitude pulse mode, measure the pressure and determine the amplitude of the high amplitude pressure pulse during the high amplitude pulse mode, and increase the amplitude of the high amplitude pressure pulse by operating the pulse generator in the reduced flow configuration for a time period longer than the default time period when the determined amplitude of the high amplitude pressure pulse is below the low amplitude reference pressure.

The memory can further comprise program code executable by the controller to measure the pressure and determine the amplitude of the low amplitude pressure pulse during the low amplitude pulse mode, and operate the pulse generator in the high amplitude pulse mode when the determined amplitude of the low amplitude pressure pulse is below the low amplitude reference pressure.

The memory can further comprise program code executable by the controller to measure the pressure and determine the amplitude of the high amplitude pressure pulse during the high amplitude pulse mode, and operate the pulse generator in the low amplitude pulse mode when the determined amplitude of the high amplitude pressure pulse is above the high amplitude reference pressure.

According to another aspect of the invention, a fluid pressure pulse telemetry apparatus is provided which comprises the aforementioned fluid pressure pulse generator, motor subassembly, pressure transducer and electronics subassembly, except that the memory has program code stored thereon that is executable by the controller to perform the following method: operating the pulse generator between the full and intermediate flow configurations in a low amplitude pulse mode to transmit a telemetry signal to surface and reading the pressures of the no pulse and low amplitude pressure pulse from the pressure transducer; determining an amplitude of the low amplitude pressure pulse from the measured pressures; and when the determined amplitude of the low amplitude pressure pulse is below a low amplitude reference pressure, operating the pulse generator between the full and reduced flow configurations in a high amplitude pulse mode to transmit a telemetry signal to surface.

According to another aspect of the invention, a fluid pressure pulse telemetry apparatus is provided which comprises the aforementioned fluid pressure pulse generator, motor subassembly, pressure transducer and electronics subassembly, except that the memory has program code stored thereon that is executable by the controller to perform the following method: operating the pulse generator between the full and reduced flow configurations in a high amplitude pulse mode to transmit a telemetry signal to surface and measuring the pressures of the no pulse and high amplitude pressure pulse; and determining an amplitude of the high amplitude pressure pulse from the measured pressures; and when the determined amplitude of the high amplitude pressure pulse is above a high amplitude reference pressure, operating the pulse generator between the full and intermediate flow configurations in a low amplitude pulse mode to transmit a telemetry signal to surface.

DETAILED DESCRIPTION

Apparatus Overview

The embodiments described herein generally relate to a MWD tool having a fluid pressure pulse generator. The fluid pressure pulse generator of the embodiments described herein may be used for mud pulse (MP) telemetry used in downhole drilling. The fluid pressure pulse generator may alternatively be used in other methods where it is necessary to generate a fluid pressure pulse.

Figure 1:
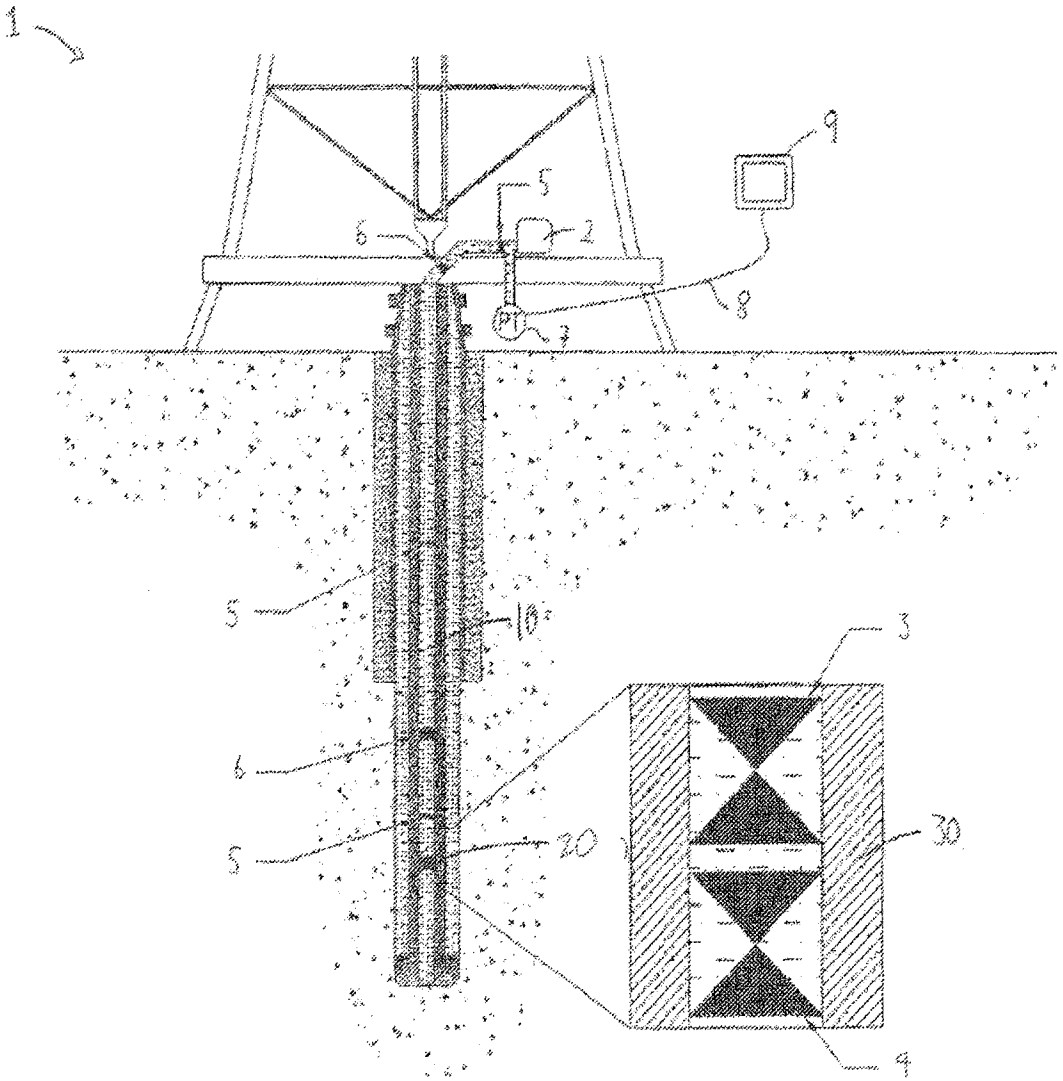
FIG. 1 is a schematic of a drill string in an oil and gas borehole comprising a MWD telemetry tool in accordance with embodiments of the invention.

Referring to the drawings and specifically to FIG. 1, there is shown a schematic representation of a MP telemetry method using the fluid pressure pulse generator embodiments of the invention. In downhole drilling equipment 1, drilling fluid or "mud" is pumped down a drill string by pump 2 and passes through a measurement while drilling (MWD) tool 20. The MWD tool 20 includes a fluid pressure pulse generator 30, according to embodiments of the invention. The fluid pressure pulse generator 30 has a reduced flow configuration (schematically represented as valve 3) which generates a full positive pressure pulse (represented schematically as full pressure pulse 6) and an intermediate flow configuration (schematically represented as valve 4) which generates an intermediate positive pressure pulse (represented schematically as intermediate pressure pulse 5). Intermediate pressure pulse 5 is reduced compared to the full pressure pulse 6. Information acquired by downhole sensors (not shown) is transmitted in specific time divisions by the pressure pulses 5, 6 in mud column 10. More specifically, signals from sensor modules in the MWD tool 20 or in another probe (not shown) are received and processed in a data encoder in the MWD tool 20 where the data is digitally encoded as is well established in the art. This data is sent to a controller in the MWD tool 20 which then actuates the fluid pressure pulse generator 30 to generate pressure pulses 5, 6 which contain the encoded data. The pressure pulses 5, 6 are transmitted to the surface and detected by a surface pressure transducer 7. The measured pressure pulses are transmitted as electrical signals through transducer cable 8 to a surface computer 9 which decodes and displays the transmitted information to the drilling operator.

The characteristics of the pressure pulses 5, 6 are defined by amplitude, duration, shape, and frequency, and these characteristics are used in various encoding systems to represent binary data. The ability to produce two different sized pressure pulses 5, 6, allows for greater variation in the binary data being produced and therefore quicker and more accurate interpretation of downhole measurements.

One or more signal processing techniques are used to separate undesired mud pump noise, rig noise or downward propagating noise from upward MWD signals. The data transmission rate is governed by Lamb's theory for acoustic waves in a drilling mud and is about 1.1 to 1.5 km/s. The fluid pressure pulse generator 30 tends to operate in an unfriendly environment under high static downhole pressures, high temperatures, high flow rates and various erosive flow types. The fluid pressure pulse generator 30 generates pulses between 100-300 psi and typically operates in a flow rate as dictated by the size of the drill pipe bore, and limited by surface pumps, drill bit total flow area (TFA), and mud motor/turbine differential requirements for drill bit rotation.

Figure 2:
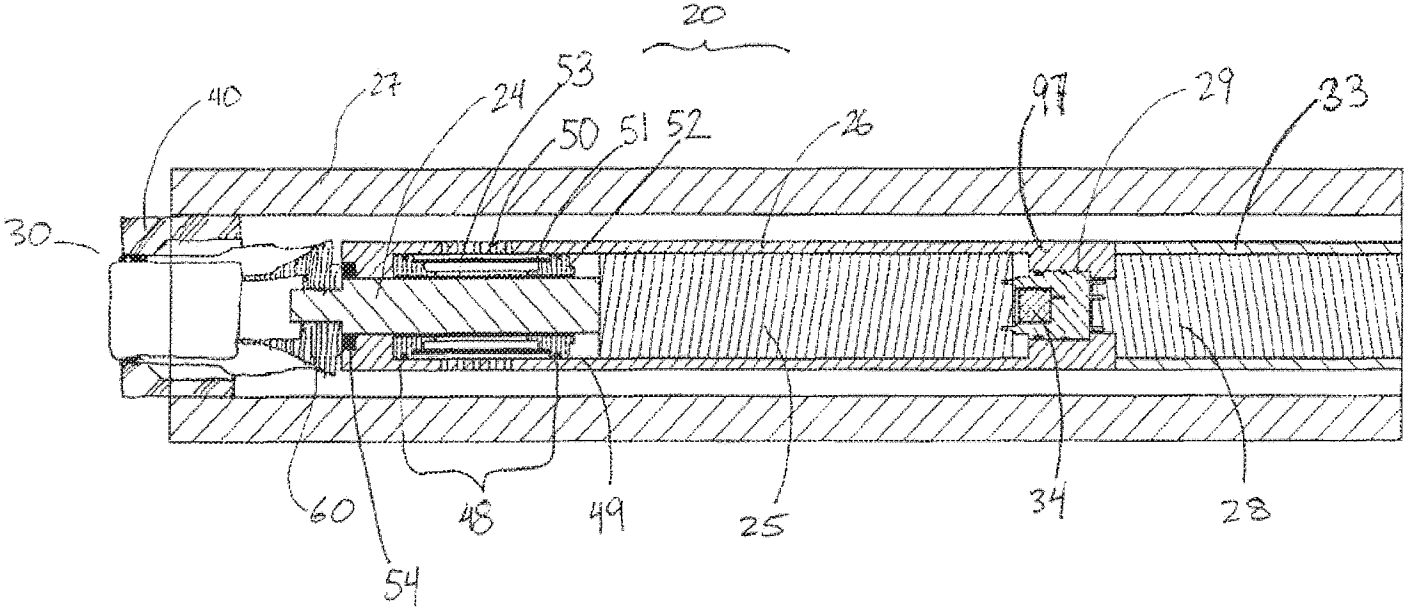
FIG. 2 is a longitudinally sectioned view of a mud pulser section of the MWD tool comprising a pressure transducer and feed through subassembly between an electronics housing and a mud housing according to an embodiment of the invention.
Figure 3:
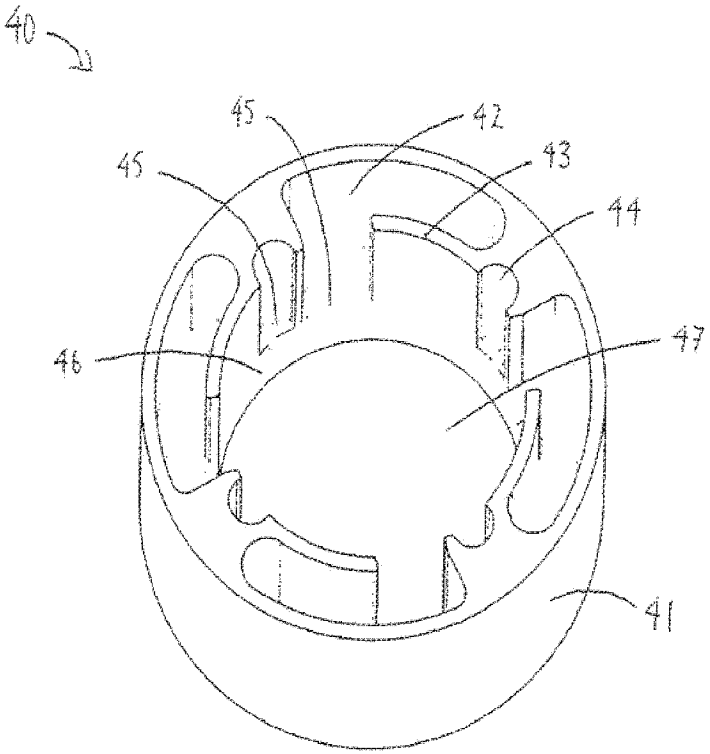
FIG. 3 is a perspective view of a stator of a fluid pressure pulse generator of the MWD tool.
Figure 4:
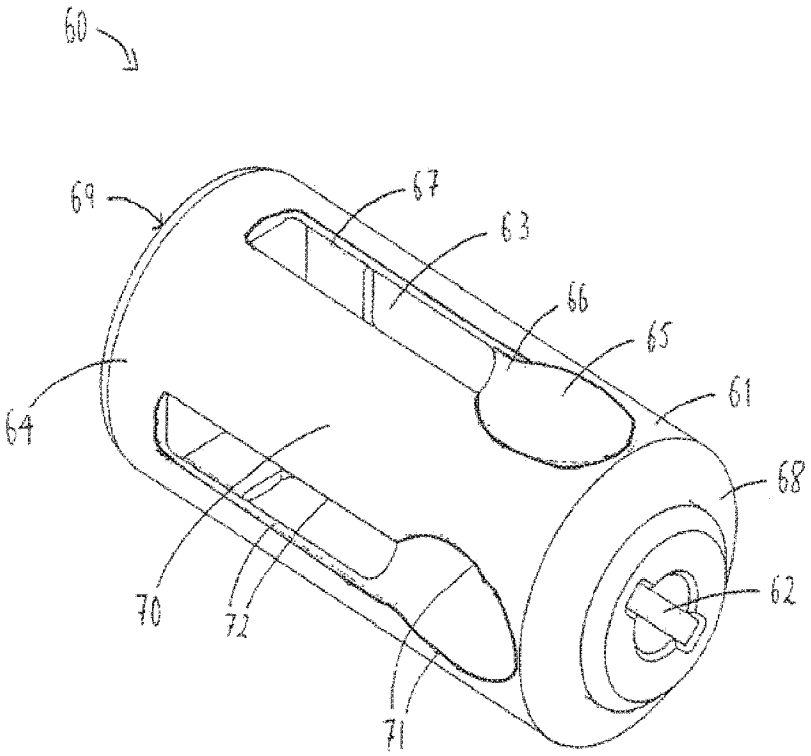
FIG. 4 is a perspective view of a rotor of the fluid pressure pulse generator.

Referring to FIG. 2, the MWD tool 20 is shown in more detail. The MWD tool 20 generally comprises the fluid pressure pulse generator 30 which creates the fluid pressure pulses, and a pulser assembly 26 which takes measurements while drilling and which drives the fluid pressure pulse generator 30; the pulse generator 30 and pulser assembly 26 are axially located inside a drill collar (not shown) with an annular gap therebetween to allow mud to flow through the gap. The fluid pressure pulse generator 30 generally comprises a stator 40 and a rotor 60. The stator 40 is fixed to a landing sub 27 and the rotor 60 is fixed to a drive shaft 24 of the pulser assembly 26. The pulser assembly 26 is fixed to the drill collar. The pulser assembly 26 includes a pulse generator motor subassembly 25 and an electronics subassembly 28 electronically coupled together but fluidly separated by a feed-through connector 29. The motor subassembly 25 includes a pulse generator motor housing 49 which houses components including a pulse generator motor (not shown), gearbox (not shown), and a pressure compensation device 48. The electronics subassembly 28 includes a electronics housing 33 which is coupled to an end of the pulse generator motor housing 49 and which houses downhole sensors, control electronics, and other components (not shown) required by the MWD tool 20 to determine the direction and inclination information and to take measurements of drilling conditions, to encode this telemetry data using one or more known modulation techniques into a carrier wave, and to send motor control signals to the pulse generator motor to rotate the drive shaft 24 and rotor 60 in a controlled pattern to generate pressure pulses 5, 6 representing the carrier wave for transmission to surface.

The motor subassembly 25 is filled with a lubricating liquid such as hydraulic oil or silicon oil; this lubricating liquid is fluidly separated from the mud flowing through the pulse generator 30; however, the pressure compensation device 48 comprises a flexible membrane 51 in fluid communication with both the mud and the lubrication liquid, which allows the pressure compensation device 48 to maintain the pressure of the lubrication liquid at about the same pressure as the drilling mud at the pulse generator 30. As will be described in more detail below, a pressure transducer 34 is seated inside the feed through connector 29 (collectively "pressure transducer and feed through subassembly 29, 34") and faces the inside of the pulse generator motor housing. The pressure transducer 34 can thus measure the pressure of the lubrication liquid, and hence the pressure of the drilling mud; this enables the pressure transducer 34 to take pressure measurements of pressure pulses 5, 6 generated by the pulse generator 30 while being protected from the harsh environment of drilling mud.

The fluid pulse generator 30, the pressure compensation device 48, and the pressure transducer and feed through subassembly 29, 34 will now each be described in more detail:

Fluid Pressure Pulse Generator

The fluid pressure pulse generator 30 is located at the downhole end of the MWD tool 20. Drilling fluid pumped from the surface by pump 2 flows between the outer surface of the pulser assembly 26 and the inner surface of the landing sub 27. When the fluid reaches the fluid pressure pulse generator 30 it is diverted through fluid openings 67 in the rotor 60 and exits the internal area of the rotor 60 as will be described in more detail below with reference to FIGS. 3 to 7. In different configurations of the rotor 60/stator 40 combination, the fluid flow area varies, thereby creating positive pressure pulses 5, 6 that are transmitted to the surface as will be described in more detail below.

Figure 5:
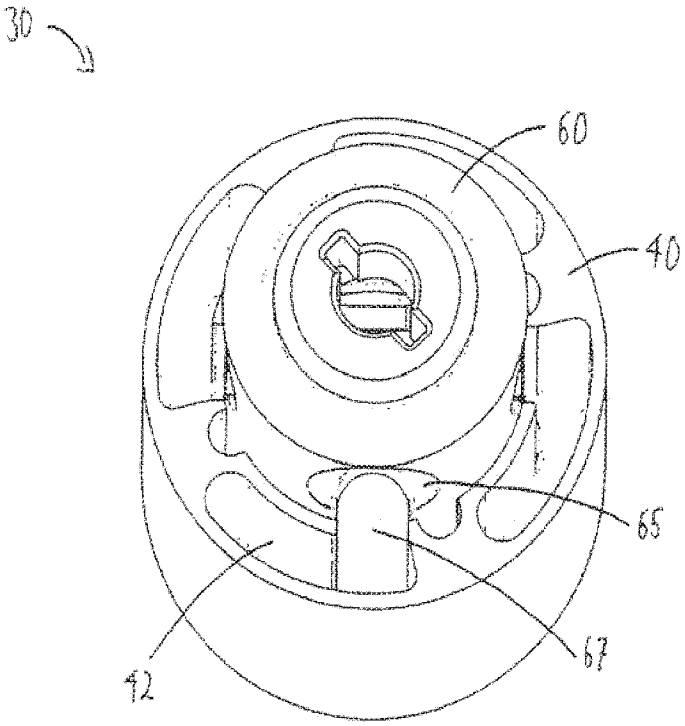
FIG. 5 is a perspective view of the rotor/stator combination of the fluid pressure pulse generator in full flow configuration.
Figure 6:
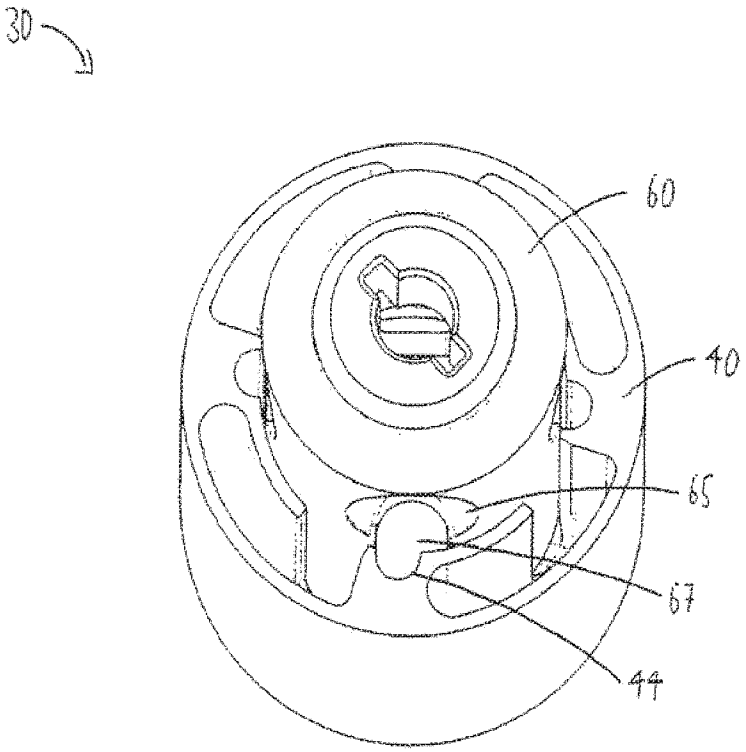
FIG. 6 is a perspective view of the rotor/stator combination of FIG. 5 in intermediate flow configuration.
Figure 7:
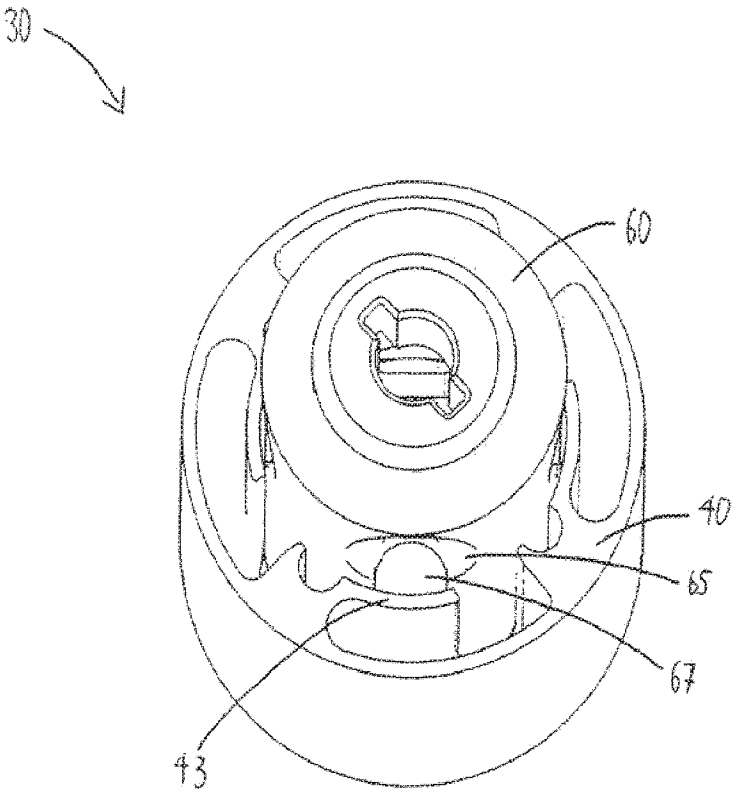
FIG. 7 is a perspective view of the rotor/stator combination of FIG. 5 in reduced flow configuration.

Referring now to FIGS. 3 to 7, there is shown the stator 40 and rotor 60 which combine to form the fluid pressure pulse generator 30 according to a first embodiment of the invention. The rotor 60 comprises a circular body 61 having an uphole end 68 with a drive shaft receptacle 62 and a downhole opening 69. The drive shaft receptacle 62 is configured to receive and fixedly connect with the drive shaft 24 of the pulser assembly 26, such that in use the rotor 60 is rotated by the drive shaft 24. The stator 40 comprises a stator body 41 with a circular opening 47 therethrough sized to receive the circular body 61 of the rotor as shown in FIGS. 5 to 7. The stator body 41 may be annular or ring shaped as shown in the embodiment of FIGS. 3 to 7, to enable it to fit within a drill collar of a downhole drill string, however in alternative embodiments (not shown) the stator body may be a different shape, for example square shaped, rectangular shaped, or oval shaped depending on the fluid pressure pulse operation it is being used for.

The stator 40 and rotor 60 are made up of minimal parts and their configuration beneficially provides easy line up and fitting of the rotor 60 within the stator 40. There is no positioning or height requirement and no need for an axial gap between the stator 40 and the rotor 60 as is required with known rotating disc valve pulsers. It is therefore not necessary for a skilled technician to be involved with set up of the fluid pressure pulse generator 30 and the operator can easily change or service the stator 40/rotor 60 combination if flow rate conditions change or there is damage to the rotor 60 or stator 40 during operation.

The circular body 61 of the rotor has four rectangular fluid openings 67 separated by four leg sections 70 and a mud lubricated journal bearing ring section 64 defining the downhole opening 69. The bearing ring section 64 helps centralize the rotor 60 in the stator 40 and provides structural strength to the leg sections 70. The circular body 61 also includes four depressions 65 that are shaped like the head of a spoon on an external surface of the circular body 61. Each spoon shaped depression 65 is connected to one of the fluid openings 67 by a flow channel 66 on the external surface of the body 61. Each connected spoon shaped depression 65, flow channel 66 and fluid opening 67 forms a fluid diverter and there are four fluid diverters positioned equidistant circumferentially around the circular body 61.

The spoon shaped depressions 65 and flow channels 66 direct fluid flowing in a downhole direction external to the circular body 61, through the fluid openings 67, into a hollow internal area 63 of the body, and out of the downhole opening 69. The spoon shaped depressions 65 gently slope, with the depth of the depression increasing from the uphole end to the downhole end of the depression ensuring that the axial flow path or radial diversion of the fluid is gradual with no sharp turns. This is in contrast to the stator/rotor combination described in U.S. Pat. No. 8,251,160, where windows in the stator and the rotor align to create a fluid flow path orthogonal to the windows through the rotor and stator. The depth of the spoon shaped depressions 65 can vary depending on flow parameter requirements.

The spoon shaped depressions 65 act as nozzles to aid fluid flow. Without being bound by science, it is thought that the nozzle design results in increased volume of fluid flowing through the fluid opening 67 compared to an equivalent fluid diverter without the nozzle design, such as the window fluid opening of the rotor/stator combination described in U.S. Pat. No. 8,251,160. Curved edges 71 of the spoon shaped depressions 65 also provide less resistance to fluid flow and reduction of pressure losses across the rotor/stator as a result of optimal fluid geometry. Furthermore, the curved edges 71 of the spoon shaped depressions 65 have a reduced surface compared to, for example, a channel having the same flow area as the spoon shaped depression 65. This means that the surface area of the curved edges 71 cutting through fluid when the rotor is rotated is minimized, thereby minimizing the force required to turn the rotor and reducing the pulse generator motor torque requirement. By reducing the pulse generator motor torque requirement, there is beneficially a reduction in battery consumption and less wear on the motor, beneficially minimizing costs.

Motor torque requirement is also reduced by minimizing the surface area of edges 72 of each leg section 70 which are perpendicular to the direction of rotation. Edges 72 cut through the fluid during rotation of the rotor 60 and therefore beneficially have as small a surface area as possible whilst still maintaining structural stability of the leg sections 70. To increase structural stability of the leg sections 70, the thickness at the middle of the leg section 70 furthest from the edges 72 may be greater than the thickness at the edges 72, although the wall thickness of each leg section 70 may be the same throughout. In addition, the bearing ring section 64 of the circular body 61 provides structural stability to the leg sections 70.

In alternative embodiments (not shown) a different curved shaped depression other than the spoon shaped depression may be utilized on the external surface of the rotor, for example, but not limited to, egg shaped, oval shaped, arc shaped, or circular shaped. Furthermore, the flow channel 66 need not be present and the fluid openings 67 may be any shape that allows flow of fluid from the external surface of the rotor through the fluid openings 67 to the hollow internal area 63.

The stator body 41 includes four full flow chambers 42, four intermediate flow chambers 44 and four walled sections 43 in alternating arrangement around the stator body 41. In the embodiment shown in FIGS. 3 to 7, the four full flow chambers 42 are L shaped and the four intermediate flow chambers 44 are U shaped, however in alternative embodiments (not shown) other configurations may be used for the chambers 42, 44. The geometry of the chambers is not critical provided the flow area of the chambers is conducive to generating the intermediate pulse 5 and no pulse in different flow configurations as described below in more detail. A solid bearing ring section 46 at the downhole end of the stator body 41 helps centralize the rotor in the stator and minimizes flow of fluid between the external surface of the rotor 60 and the internal surface of the stator 40. Four flow sections are positioned equidistant around the circumference of the stator 40, with each flow section having one of the intermediate flow chambers 44, one of the full flow chambers 42, and one of the wall sections 43. The full flow chamber 42 of each flow section is positioned between the intermediate flow chamber 44 and the walled section 43.

In use, each of the four flow sections of the stator 40 interact with one of the four fluid diverters of the rotor 60. The rotor 60 is rotated in the fixed stator 40 to provide three different flow configurations as follows:

1. Full flow—where the rotor fluid openings 67 align with the stator full flow chambers 42, as shown in FIG. 5;
2. Intermediate flow—where the rotor fluid openings 67 align with the stator intermediate flow chambers 44, as shown in FIG. 6; and
3. Reduced flow—where the rotor fluid openings 67 align with the stator walled sections 43, as shown in FIG. 7.

In the full flow configuration shown in FIG. 5, the stator full flow chambers 42 align with the fluid openings 67 and flow channels 66 of the rotor, so that fluid flows from the full flow chambers 42 through the fluid openings 67. The flow area of the full flow chambers 42 may correspond to the flow area of the rotor fluid openings 67. This corresponding sizing beneficially leads to no or minimal resistance in flow of fluid through the fluid openings 67 when the rotor is positioned in the full flow configuration. There is zero pressure increase and no pressure pulse is generated in the full flow configuration. The L shaped configuration of the chambers 42 minimizes space requirement as each L shaped chamber tucks behind one of the walled sections 43 allowing for a compact stator design, which beneficially reduces production costs and results in less likelihood of blockage.

When the rotor is positioned in the reduced flow configuration as shown in FIG. 7, there is no flow area in the stator as the walled section 43 aligns with the fluid openings 67 and flow channels 66 of the rotor. Fluid is still diverted by the spoon shaped depressions 65 along the flow channels 66 and through the fluid openings 67, however, the total overall flow area is reduced compared to the total overall flow area in the full flow configuration. The fluid pressure therefore increases to generate the full pressure pulse 6.

In the intermediate flow configuration as shown in FIG. 6, the intermediate flow chambers 44 align with the fluid openings 67 and flow channels 66 of the rotor, so that fluid flows from the intermediate flow chambers 44 through the fluid openings 67. The flow area of the intermediate flow chambers 44 is less than the flow area of the full flow chambers 42, therefore, the total overall flow area in the intermediate flow configuration is less than the total overall flow area in the full flow configuration, but more than the total overall flow area in the reduced flow configuration. As a result, the flow of fluid through the fluid openings 67 in the intermediate flow configuration is less than the flow of fluid through the fluid openings 67 in the full flow configuration, but more than the flow of fluid through the fluid openings 67 in the reduced flow configuration. The intermediate pressure pulse 5 is therefore generated which is reduced compared to the full pressure pulse 6. The flow area of the intermediate flow chambers 44 may be one half, one third, one quarter the flow area of the full flow chambers 42, or any amount that is less than the flow area of the full flow chambers 42 to generate the intermediate pressure pulse 5 and allow for differentiation between pressure pulse 5 and pressure pulse 6.

When the rotor 60 is positioned in the reduced flow configuration as shown in FIG. 7, fluid is still diverted by the spoon shaped depressions 65 along the flow channels 66 and through the fluid openings 67 otherwise the pressure build up would be detrimental to operation of the downhole drilling. In contrast to the rotor/stator combination disclosed in U.S. Pat. No. 8,251,160, where the constant flow of fluid is through a plurality of circular holes in the stator, in the present embodiment, the constant flow of fluid is through the rotor fluid openings 67. This beneficially reduces the likelihood of blockages and also allows for a more compact stator design as there is no need to have additional fluid openings in the stator.

A bottom face surface 45 of both the full flow chambers 42 and the intermediate flow chambers 44 of the stator 40 may be angled in the downhole flow direction for smooth flow of fluid from chambers 42, 44 through the rotor fluid openings 67 in the full flow and intermediate flow configurations respectively, thereby reducing flow turbulence. In all three flow configurations the full flow chambers 42 and the intermediate flow chambers 44 are filled with fluid, however fluid flow from the chambers 42, 44 will be restricted unless the rotor fluid openings 67 are aligned with the full flow chambers 42 or intermediate flow chambers 44 in the full flow and intermediate flow configurations respectively.

A combination of the spoon shaped depressions 65 and flow channels 66 of the rotor 60 and the angled bottom face surface 45 of the chambers 42, 44 of the stator provide a smooth fluid flow path with no sharp angles or bends. The smooth fluid flow path beneficially minimizes abrasion and wear on the pulser assembly 26.

Provision of the intermediate flow configuration allows the operator to choose whether to use the reduced flow configuration, intermediate flow configuration or both configurations to generate pressure pulses depending on fluid flow conditions. The fluid pressure pulse generator 30 can operate in a number of different flow conditions. For higher fluid flow rate conditions, for example, but not limited to, deep downhole drilling or when the drilling mud is heavy or viscous, the pressure generated using the reduced flow configuration may be too great and cause damage to the system. The operator may therefore choose to only use the intermediate flow configuration to produce detectable pressure pulses at the surface. For lower fluid flow rate conditions, for example, but not limited to, shallow downhole drilling or when the drilling mud is less viscous, the pressure pulse generated in the intermediate flow configuration may be too low to be detectable at the surface. The operator may therefore choose to operate using only the reduced flow configuration to produce detectable pressure pulses at the surface. Thus it is possible for the downhole drilling operation to continue when the fluid flow conditions change without having to change the fluid pressure pulse generator 30. For normal fluid flow conditions, the operator may choose to use both the reduced flow configuration and the intermediate flow configuration to produce two distinguishable pressure pulses 5, 6, at the surface and increase the data rate of the fluid pressure pulse generator 30.

If one of the stator chambers (either full flow chambers 42 or intermediate flow chambers 44) is blocked or damaged, or one of the stator wall sections 43 is damaged, operations can continue, albeit at reduced efficiency, until a convenient time for maintenance. For example, if one or more of the stator wall sections 43 is damaged, the full pressure pulse 6 will be affected; however operation may continue using the intermediate flow configuration to generate intermediate pressure pulse 5. Alternatively, if one or more of the intermediate flow chambers 44 is damaged or blocked, the intermediate pulse 5 will be affected; however operation may continue using the reduced flow configuration to generate the full pressure pulse 6. If one or more of the full flow chambers 42 is damaged or blocked, operation may continue by rotating the rotor between the reduced flow configuration and the intermediate flow configuration. Although there will be no zero pressure state, there will still be a pressure differential between the full pressure pulse 6 and the intermediate pressure pulse 5 which can be detected and decoded on the surface until the stator can be serviced. Furthermore, if one or more of the rotor fluid openings 67 is damaged or blocked which results in one of the flow configurations not being usable, the other two flow configurations can be used to produce a detectable pressure differential. For example, damage to one of the rotor fluid openings 67 may result in an increase in fluid flow through the rotor such that the intermediate flow configuration and the full flow configuration do not produce a detectable pressure differential, and the reduced flow configuration will need to be used to get a detectable pressure pulse.

Provision of multiple rotor fluid openings 67 and multiple stator chambers 42, 44 and wall sections 43, provides redundancy and allows the fluid pressure pulse generator 30 to continue working when there is damage or blockage to one of the rotor fluid openings 67 and/or one of the stator chambers 42, 44 or wall sections 43. Cumulative flow of fluid through the remaining undamaged or unblocked rotor fluid openings 67 and stator chambers 42, 44 still results in generation of detectable full or intermediate pressure pulses 5, 6, even though the pulse heights may not be the same as when there is no damage or blockage.

It is evident from the foregoing that while the embodiments shown in FIGS. 3 to 7 utilize four fluid openings 67 together with four full flow chambers 42, four intermediate flow chambers 44 and four wall sections 43 in the stator, different numbers of rotor fluid openings 67, stator flow chambers 42, 44 and stator wall sections 43 may be used. Provision of more fluid openings 67, chambers 42, 44 and wall section 43 beneficially reduces the amount of rotor rotation required to move between the different flow configurations, however, too many openings 67, chambers 42, 44 and wall section 43 decreases the stability of the rotor and/or stator and may result in a less compact design thereby increasing production costs. Furthermore, the number of rotor fluid openings 67 need not match the number of stator flow chambers 42, 44 and stator wall sections 43. Different combinations may be utilized according to specific operation requirements of the fluid pressure pulse generator. In alternative embodiments (not shown) the intermediate flow chambers 44 need not be present or there may be additional intermediate flow chambers present that have a flow area less than the flow area of full flow chambers 42. The flow area of the additional intermediate flow chambers may vary to produce additional intermediate pressure pulses and increase the data rate of the fluid pressure pulse generator 30. The innovative aspects of the invention apply equally in embodiments such as these.

It is also evident from the foregoing that while the embodiments shown in FIGS. 3 to 7 utilize fluid openings in the rotor and flow chambers in the stator, in alternative embodiments (not shown) the fluid openings may be positioned in the stator and the flow chambers may be present in the rotor. In these alternative embodiments the rotor still rotates between full flow, intermediate flow and reduced flow configurations whereby the fluid openings in the stator align with full flow chambers, intermediate flow chambers and wall sections of the rotor respectively. The innovative aspects of the invention apply equally in embodiments such as these.

Pressure Compensation Device

Referring again to FIG. 2, the motor subassembly 25 is provided with a pressure compensation device 48 which equalizes the pressure inside the motor subassembly 25 with the pressure of the drilling fluid outside of the mud pulser assembly 26, so to equalize pressure across a primary seal 54 of the motor subassembly 25 thereby sealing out the drilling fluid from the inside of the motor subassembly 25. More particularly, the pressure compensation device 48 enables the pressure transducer 34 to measure the pressure of the pressure pulses 5, 6 generated by the pulse generator 30, as will be described in more detail below.

The pressure compensation device 48 comprises a generally tubular pressure compensated housing which extends around the driveshaft 24 near the driveshaft end (otherwise referred to as the downhole end) of the motor subassembly 25 and downhole from the pulse generator motor and gearbox. The pressure compensated housing in this embodiment is an extension of the pulse generator motor housing 49 of the motor subassembly 25, but alternatively can be a separate component which is connected to the pulse generator motor housing 49. The pressure compensated housing comprises a plurality of ports 50 which extend radially through the housing wall. A cylindrical pressure compensation membrane 51 is located inside the pressure compensated housing underneath the ports 50, and is fixed in place by a pressure compensation membrane support 52. The support 52 is a generally cylindrical structure with a central bore that allows the driveshaft 24 to extend therethrough. The support 52 has two end sections with an outer diameter that abuts against the inside surface of the pressure compensated housing 49; a pair of O-ring seals each located in each end section serves to provide a fluid seal between the housing 49 and the end sections. The end sections each also has a membrane mount for mounting respective ends of the membrane 51. When the membrane 51 is mounted on the support 52, the support 52 and membrane 51 provide a fluid barrier between the mud that has flowed through the ports 50, and the inside of the support 52.

The support 49 also has pressure communication ports 53 which allow fluid communication between the inside of the support 49 and the rest of the motor subassembly 25 interior. As previously noted, the inside of the motor subassembly 25 is filled with a lubrication liquid; this liquid is contained inside the pulse generator motor housing 49 by a primary rotary seal 54 which provides a fluid seal between the driveshaft 24 and the pulse generator motor housing 49.

More particularly, the downhole end of the motor subassembly 25 comprises an end cap (not shown) with a bore for allowing the drive shaft 24 to extend therethrough. The end cap serves to cap the driveshaft end of the pulse generator motor housing 49 and keep the primary seal 54 in place. The primary seal 54 is seated in an annular shoulder at the downhole end of the pressure compensated housing 49.

As is known in the art, the membrane 51 can flex to compensate for pressure changes in the drilling mud and allow the pressure of the pressure compensated liquid to substantially equalize with the pressure of the drilling mud.

Electronics Subassembly

Figure 8:
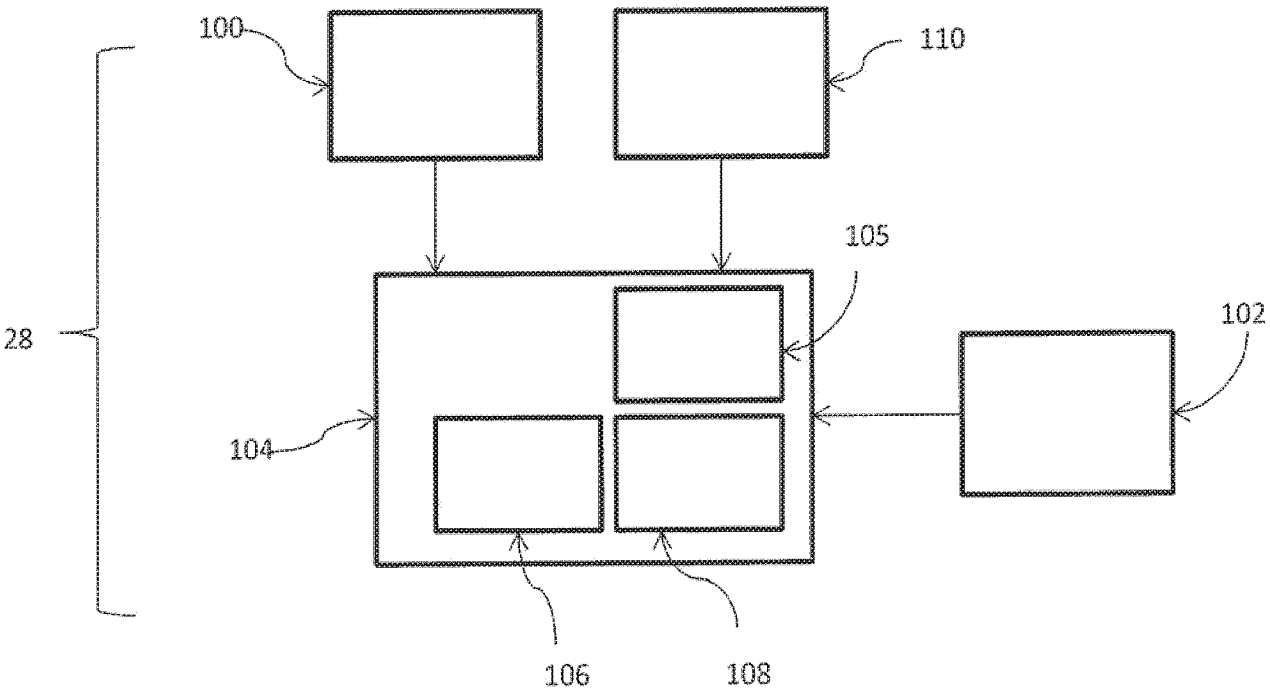
FIG. 8 is a schematic block diagram of components of an electronics subassembly of the MWD tool.
Figure 10:
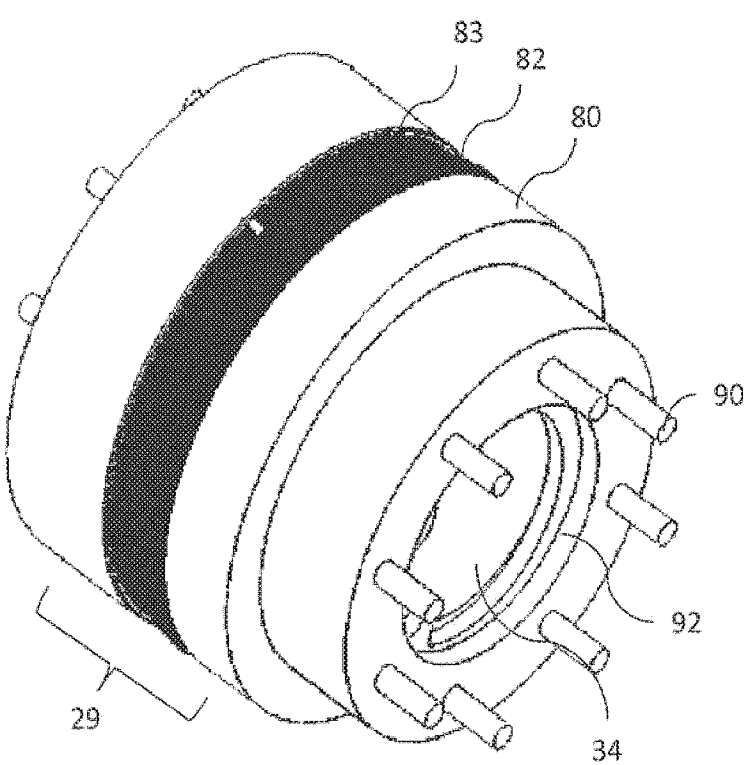
FIG. 10 is a perspective view of a high pressure end of the pressure transducer and feed through subassembly shown in the FIG. 9.
Figure 9:
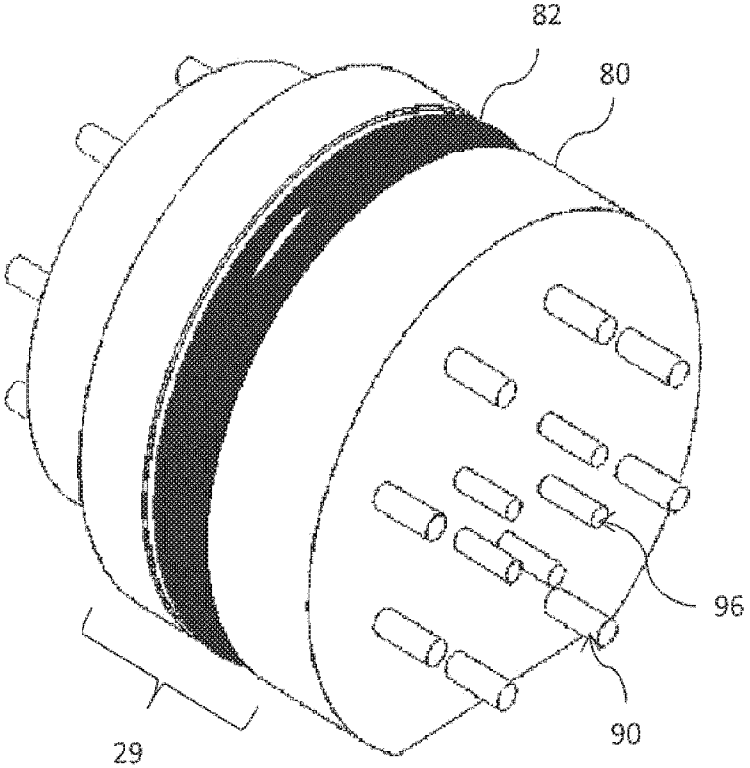
FIG. 9 is a perspective view of a low pressure end of the pressure transducer and feed through subassembly of the MWD tool according to a first embodiment.
Figure 11:
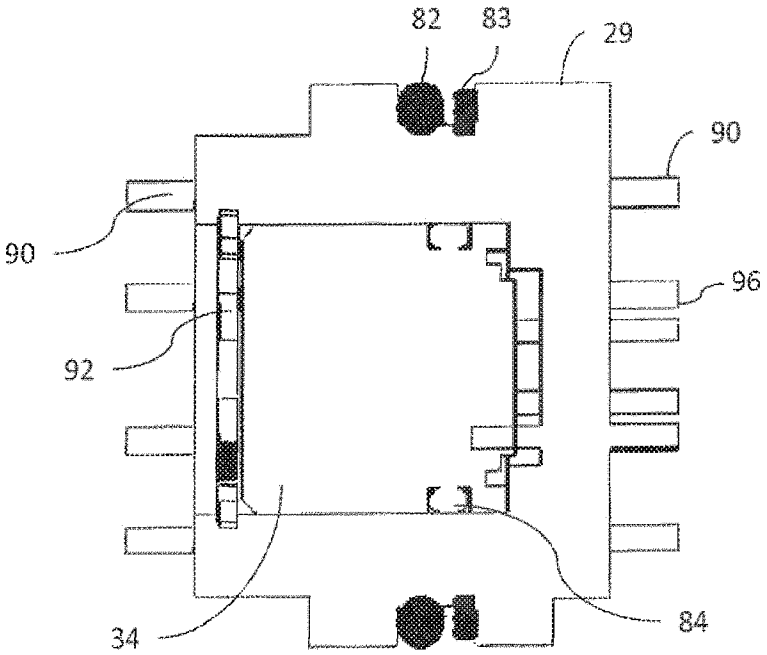
FIG. 11 is a longitudinally sectioned view of the pressure transducer and feed through subassembly shown in FIG. 9.

Referring now to FIG. 8, the electronics subassembly 28 includes components that determine direction and inclination of the drill string, take measurements of the drilling conditions, and encode the direction and inclination information and drilling condition measurements (collectively, "telemetry data") into a carrier wave for transmission by the pulse generator 30. More particularly, the electronics subassembly 28 comprises a directional and inclination (D&I) sensor module 100, drilling conditions sensor module 102, a main circuit board 104 containing a data encoder 105, a central processing unit (controller) 106 and a memory 108 having stored thereon program code executable by the controller 106 and encoder 105, and a battery stack 110.

The D&I sensor module 100 comprises three axis accelerometers, three axis magnetometers and associated data acquisition and processing circuitry. Such D&I sensor modules are well known in the art and thus are not described in detail here.

The drilling conditions sensor module 102 include sensors mounted on a circuit board for taking various measurements of borehole parameters and conditions such as temperature, pressure, shock, vibration, rotation and directional parameters. Such sensor modules 102 are also well known in the art and thus are not described in detail here.

The main circuit board 104 can be a printed circuit board with electronic components soldered on the surface of the board. The main circuit board 104 and the sensor modules 100, 102 are secured on a carrier device (not shown) which is fixed inside the electronics housing 33 by end cap structures (not shown). The sensor modules 100, 102 are each electrically communicative with the main circuit board 104 and send measurement data to the encoder 105. The pressure transducer 34 is also electrically communicative with the main circuit board 104 and sends pressure measurement data to the encoder 105. The encoder 105 is programmed to encode this measurement data into a carrier wave using known modulation techniques. The controller 106 then sends control signals to the pulse generator to generate pressure pulses corresponding to the carrier wave determined by the encoder 105.

As will be described below, the memory 108 contains program code that can be executed by the controller 106 to carry out a number of methods that utilize the pressure measurement data. In particular, the pressure measurement data can be used in programmed methods for: predicting the life of the primary seal 54 in the motor subassembly 25, controlling pressure pulse amplitude in a dual height pressure pulse generator, and detecting a component failure which results in a change in pressure, such as venting from a battery failure.

Pressure Transducer and Feed Through Subassembly

Embodiments of the pressure transducer and feed through subassembly 29, 34 will now be described in detail with reference to FIGS. 9 to 20, with FIGS. 9 to 12 referring to a first embodiment, FIGS. 13 to 16 referring to a second embodiment, and FIGS. 17 to 20 referring to a third embodiment.

In each of the three embodiments, the feed through connector 29 is located between and electrically interconnects and fluidly separates the motor subassembly 25 and the electronics subassembly 28. Such feed through connectors 29 are known in the art, and a number can be adapted for use for the pressure transducer and feed through subassembly 29, 34. A suitable feed through connector 29, whether custom designed or adapted from commercially available products, has a body 80 which is pressure rated to withstand the pressures and pressure differentials inside the low-pressure electronics subassembly 28 (approximately atmospheric pressure) and inside the high-pressure motor subassembly 25 where pressures can reach about 20,000 psi, while still allowing electrical connectors to pass through the feed through connector 29. In alternate embodiments, the body 80 can be pressure rated to withstand up to 38,000 psi.

In the first embodiment of the pressure transducer and feed through subassembly 29, 34, the body 80 has a generally cylindrical shape with a first end ("high pressure end") facing the inside of the motor subassembly 25 and a second end ("low pressure end") facing the inside of the electronics subassembly 28. The body 80 is provided with circumferential shoulders and channels on which feed through O-ring seals 82, 83 are mounted. These feed through O-ring seals 82, 83 are provided to ensure a fluid seal is established between interiors of the electronics housing 33 and the pulse generator motor housing 49 when the feed-through 29 is in place.

The feed through connector 29 also comprises electrical interconnections which extend axially through the length of the body 80 and comprise pins which protrude from each end of the body 80; these electrical interconnections include electric motor interconnects 90 which transmit power and control signals from components in the electronics subassembly 28 and the pulse generator motor in the motor subassembly 25, as well as data from the pulse generator motor back to the components in the electronics subassembly 28. The pins of these interconnects 90 mate with electrical sockets (not shown) of the corresponding connectors of the pulse generator motor and power and control equipment.

At the high-pressure end of the body 80 is provided with a receptacle in which the pressure transducer 34 is seated. In this embodiment, the receptacle is located centrally in the high pressure end and has a depth that allows the pressure transducer 34 to be slightly recessed in the high pressure end of the body 80 with its detection surface facing outwardly from high pressure end of the body 80. A receptacle O-ring seal 84 (see FIG. 11) is located in the receptacle and provides a fluid seal between the receptacle and the pressure transducer 34. Because the receptacle extends only partway into the body 80, a communications bore (not shown) is provided that extends from base of the receptacle to the low pressure end of the body 80, and pressure transducer contacts 96 extend from the pressure transducer 34, through the communications bore, and out of the low pressure end of the body 80. These contacts 96 connect to corresponding contacts (not shown) communicative with the controller 106 and other electronic equipment inside the electronics housing 33, thereby enabling the electronic equipment to read pressure measurements from the pressure transducer 34. The pressure transducer 34 can be configured to be easily removed and replaced by being provided with relatively short male pins as contacts; in such case, a pin extension device is provided with male pins at one end and a female electrical receptacle at the other end (not shown) in the communications bore such that the female electrical receptacle electrically couples to the pressure transducer pins.

A C-shaped retention clip 92 is provided to secure the pressure transducer 34 in the receptacle. This retention clip 92 can be removed to allow the pressure transducer 34 and its connection pins 96 to be relatively easily removed from the feed through connector 29, e.g. for servicing or replacement without the need for soldering.

Figure 12:
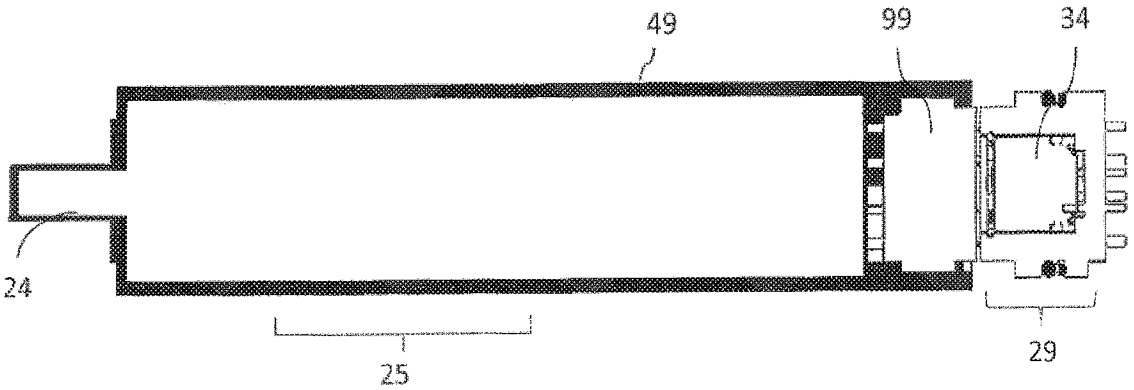
FIG. 12 is a longitudinally sectioned view of the pressure transducer and feed through subassembly shown in FIG. 9 mounted to a motor casing of the motor subassembly.
Figure 14:
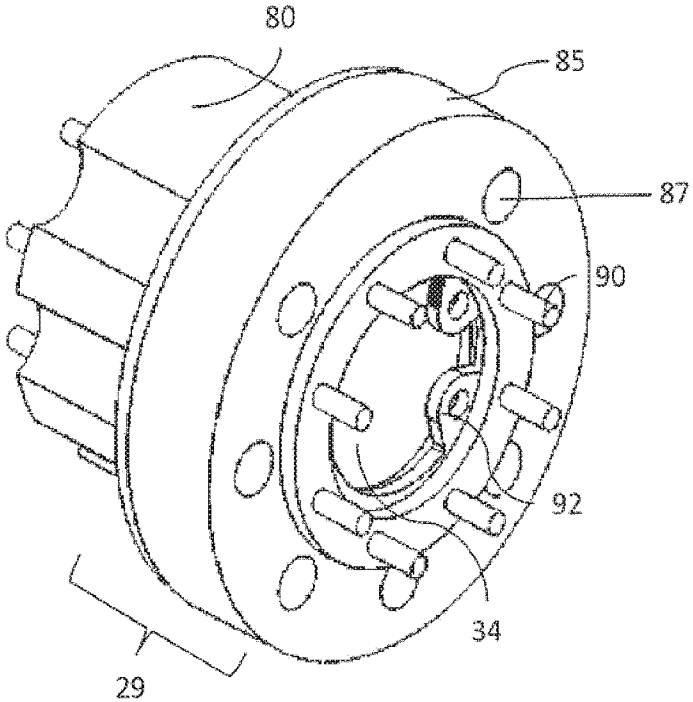
FIG. 14 is a perspective view of a high pressure end of the pressure transducer and feed through subassembly shown in the FIG. 13.
Figure 13:
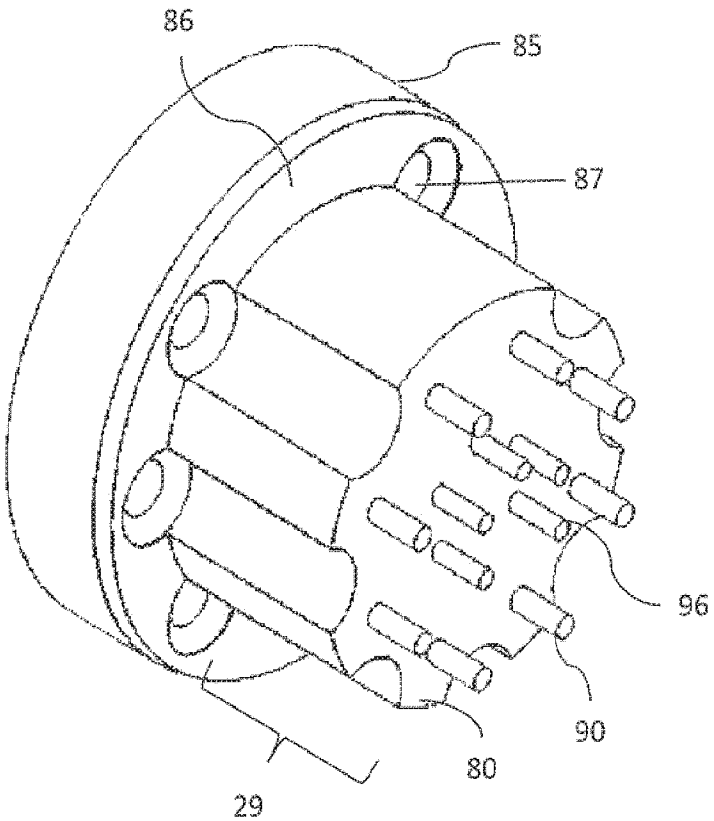
FIG. 13 is a perspective view of a low pressure end of the pressure transducer and feed through subassembly of the MWD tool according to a second embodiment.
Figure 15:
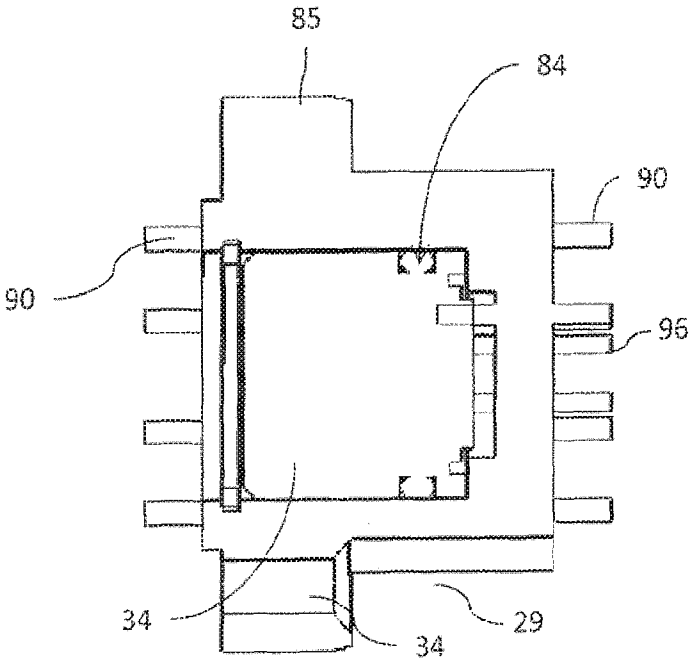
FIG. 15 is a longitudinally sectioned view of the pressure transducer and feed through subassembly shown in FIG. 13.

As can be seen in FIG. 2, the uphole end of the pulse generator motor housing 49 is provided with an annular shoulder 97 in which the pressure transducer and feed through subassembly 29, 34 is seated. Referring to FIG. 12, the electrical interconnect pins 90 engage with corresponding ports of an electrical terminal 99 of the motor. The feed through O-ring seals 82, 83 contact the annular shoulder and establish a fluid seal between the feed through connector 29 and the uphole end of the pulse generator motor housing 33, thereby establishing a fluid barrier between the interiors of the motor subassembly 25 and the electronics subassembly 28.

Referring to FIGS. 13 to 16, the second embodiment of the pressure transducer and feed through subassembly 29, 34 is the same as the first embodiment, except for the means by which it is connected to the motor subassembly 25 and establishes a fluid seal between the interiors of the motor subassembly 25 and electronics subassembly 28. In this second embodiment, the feed through connector 29 is provided with an annular flange 85 extending around the feed through body 80 and having a plurality of flange bores 87 which allow fasteners 89 such as screws to extend through the flange 85 and to engage with matingly threaded bores in the rim at the uphole end of the motor housing 49; the body 80 can be provided with open channels each aligned with a flange bore 87 to provide space for the screws to pass through the bores 85. An annular washer 86 or O-ring seal is located over the end of the flange 85 facing the rim of the uphole end of the motor housing 49, and serves to establish a fluid seal between the feed through connector 29 and the motor housing 49.

Referring to FIGS. 17 to 20, the third embodiment of the pressure transducer and feed through subassembly 29, 34 is the same as the first and second embodiments, except for the means by which it is connected to the motor subassembly 25 and establishes a fluid seal between the interiors of the motor subassembly 25 and electronics subassembly 28. In this embodiment, the feed through connector 29 is again provided with an annular flange 85 extending around the feed through body 80 but instead of having bores and using screws to fasten the flange 85 to the motor housing 49, a cylindrical collet 91 is provided for coupling the feed through connector 29 to the uphole end of the motor housing 49. More particularly, the feed through connector 29 is seated inside the collet 91 such that the flange 84 engages an annular shoulder at one end of the collet 91. The inside surface of the collet 91 is threaded, which allows the collet 91 to threadingly mate with a threaded uphole end of the motor housing 49; the collet 91 can be threaded onto the motor housing 49 until the flange 85 sealingly engages with the rim of the uphole end of the motor housing 49. An O-ring or a crush seal (not shown) can be provided around the flange 84 to establish a fluid seal with the collet 91.

Unlike conventional MWD telemetry tools which locate pressure transducers in a separate pressure probe or in complex housing which potentially exposes the transducer to a hostile environment, the pressure transducer 34 of this embodiment is located in a sealed protected environment and is exposed only to the clean lubrication liquid and not the drilling mud. Further, the pressure transducer and feed through subassembly 29, 34 eliminates the need for a separate pressure probe as well as the need for lengthy wire harnesses to connect conventional pressure transducers located in a remotely located pressure probe with the electronics of the MWD tool; also, since the pressure transducer occupies "dead space" inside the feed through connector 29, the overall length of the MWD tool 20 can be made shorter. Because the pressure transducer 34 of this embodiment is relatively rigidly fixed within the feed through connector 29, component fatigue and wear caused by vibration and movement which is a problem in systems using conventional wire-harness based connections is expected to be largely eliminated. Also, it is expected that the pressure transducer 34 of this embodiment will be more resistant to axial, lateral and torsional vibration experienced during drilling operations than pressure transducers mounted in a conventional pressure probe.

Because the pressure of the lubrication liquid corresponds to the pressure of the drilling mud at the pulse generator 30, the pressure transducer 34 can be used to measure the pressure pulses 5, 6 generated by the pulse generator 30. As will be discussed below in more detail, these measurements can be used to provide useful data for the operator to predict primary seal wear, detecting component failures, and operating the pulse generator 30 in an optimized and effective manner.

Although the pressure transducer and feed through subassembly 29, 34 of this embodiment is part of a MWD tool 20 that includes a dual height fluid pressure pulse generator 30, the pressure transducer and feed through subassembly 29, 34 can be used in other types of mud pulse MWD tools as well as certain types of EM MWD tools, including conventional single height fluid pressure pulse generators. Also, while the pressure transducer and feed through subassembly 29, 34 of this embodiment is located between the pulse generator motor and electronics subassemblies 25, 28, the pressure transducer and feed through subassembly 29, 34 can be located in other places of the MWD tool 20 where it may be useful to obtain pressure measurements.

Method of Detecting Component Failure Using Pressure Transducer Measurements

Figure 21:
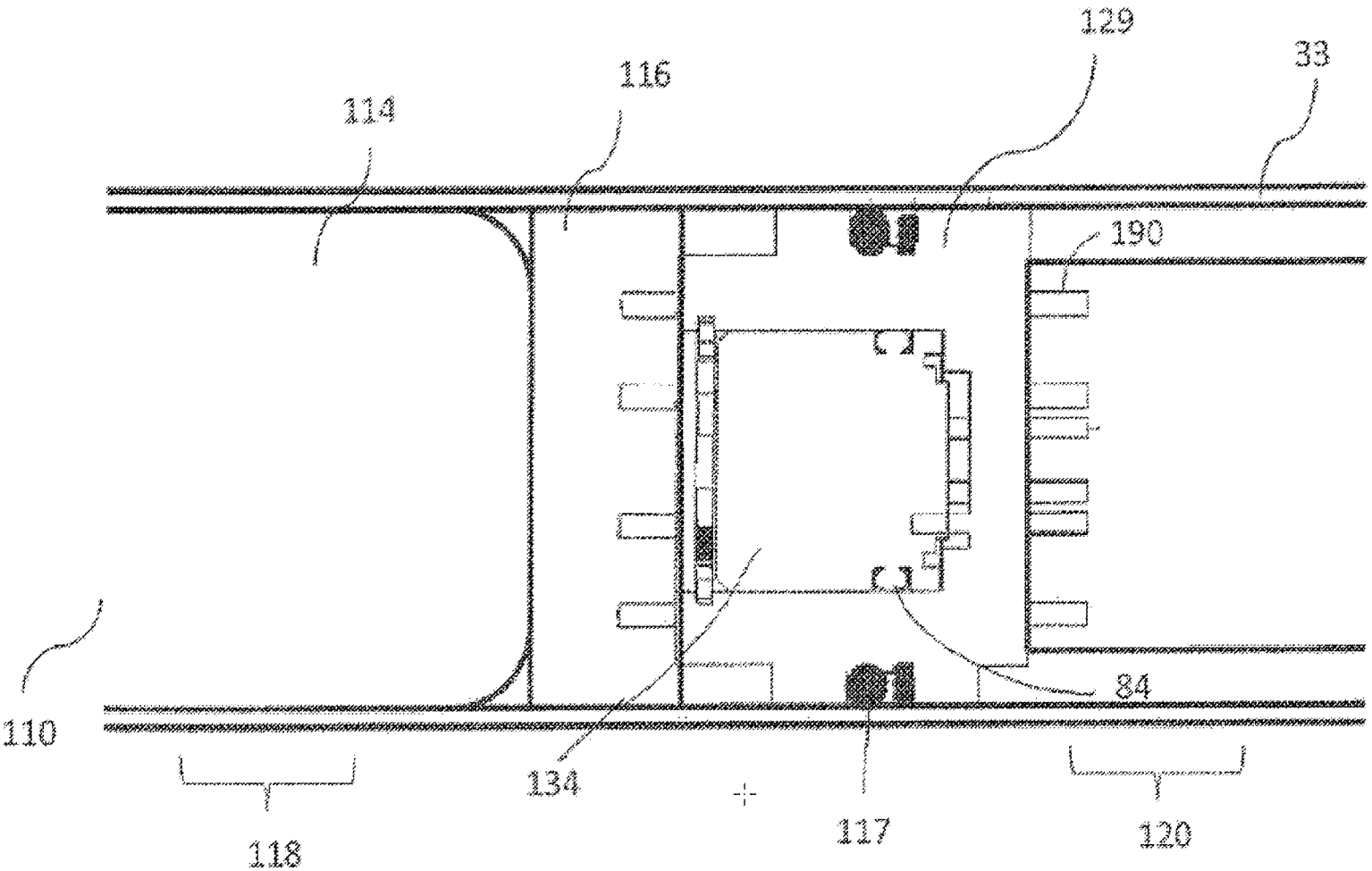
FIG. 21 is a longitudinally sectioned view of the pressure transducer of another pressure transducer and feed through subassembly mounted inside a battery section of the MWD tool, according to another embodiment of the invention.
Figure 22:
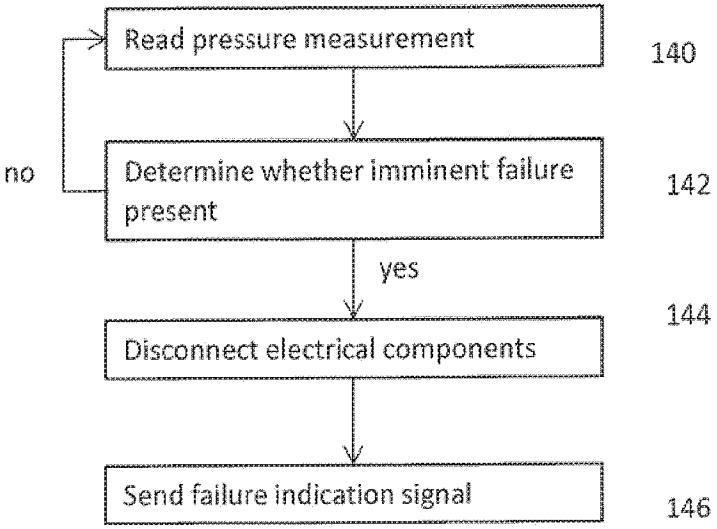
FIG. 22 is a flow chart of steps in a method for detecting a battery failure event, as programmed in a controller of the MWD tool, according to another embodiment of the invention.

According to another embodiment of the invention and referring to FIGS. 21 and 22, a second pressure transducer and feed through subassembly 129, 134 can be mounted to or near the battery pack 110 and the controller 106 can be programmed with a component failure detection program to determine a component failure from pressure measurement data received by the second pressure transducer and feed through subassembly 129, 134. In one implementation, the second pressure transducer and feed through subassembly 129, 134 can be deployed to measure the pressure in a space occupied by the battery pack 110, and the component failure detection program can be programmed to detect a battery failure event, signified by a rise in internal pressure within the compartment housing the battery caused by a battery venting.

Referring to FIG. 21, the battery pack 110 comprises a battery stack comprising a plurality of batteries 114 arranged end-to-end and a number of battery terminals 116 which contact the battery stack. The second pressure transducer and feed through subassembly 129, 134 is mounted inside the electronics subassembly housing 33 and is physically and electrically connected to one of the battery terminals 116. O-ring seals 117 of the feed through connector 129 create two fluid tight compartments in the battery housing 102, namely a first compartment 118 which houses the battery pack 110 and a second compartment 120 which houses the other electronic components of the electronics subassembly 28. Both compartments 118, 120 are generally filled with air at approximately surface atmospheric pressure.

Electrical interconnects 190 on the second feed through connector 129 electrically interconnect the battery terminal 116 with the electronic components inside the electronics subassembly 28 and with the pulse generator motor inside the motor subassembly 25, and provide power from the batteries to the pulse generator motor and electronic components and pressure measurement data from the pressure transducer 134 to the controller 106.

The second pressure transducer and feed through subassembly 129, 134 is mounted so that the pressure transducer 134 faces the first compartment 118 and can detect pressure changes inside the first compartment 118. The second pressure transducer 134 can be operated to continuously or periodically monitor the pressure inside the first compartment 118. The pressure inside the first compartment 118 is expected to significantly rise when one or more batteries 114 fails and vents its contents into the first compartment 118. Pressure measurement data from the second pressure transducer 134 is sent to the controller 106, which executes a battery monitor failure program stored on the memory 108. Referring now to FIG. 22, the battery monitor failure program when executed reads the pressure measurement data taken by the second pressure transducer 134 (step 140), determines whether the pressure measurement data indicates an imminent battery failure event by comparing the measured pressure in the first compartment 118 with a threshold component failure pressure (step 142), and if yes, initiates certain component failure action. The threshold component failure pressure is stored in the memory 108 and can be selected to correspond to a pressure in the first compartment caused by a certain amount of venting from the battery pack 110 that is indicative of an imminent or actual battery failure. Component failure action includes logging a "battery failure" flag on the memory 108 which can be read by an operator when the tool 20 is retrieved at surface using diagnostic equipment (not shown) connected to the controller 106 either wirelessly or by a hard line connection and/or electrically decoupling the battery stack from the pulse generator motor and other electrical components in an attempt to avoid or minimize damage associated with battery failure, e.g. by opening a switch (not shown) on the electrical circuit connecting the battery pack 110 to the controller 106 (step 144). Other component failure action includes sending a signal to a visual or audio indicator on the MWD tool 20 that a battery failure event has occurred; another battery (not shown) can be used to power the indicator, or, the existing battery can be used to send the signal before the method executes the step of disconnecting the battery (step 146), e.g. by mud pulse telemetry using the pulse generator 30 or by electromagnetic telemetry if an EM transmitter is present in the tool 20. This can be useful to warn an operator of potential harm from opening the electronics subassembly housing 28 which has pressurized contents therein due to the failure, or to proceed with extra caution when the tool approaches the surface.

Method for Predicting Seal Life Using Pressure Transducer Measurements

Figure 23:
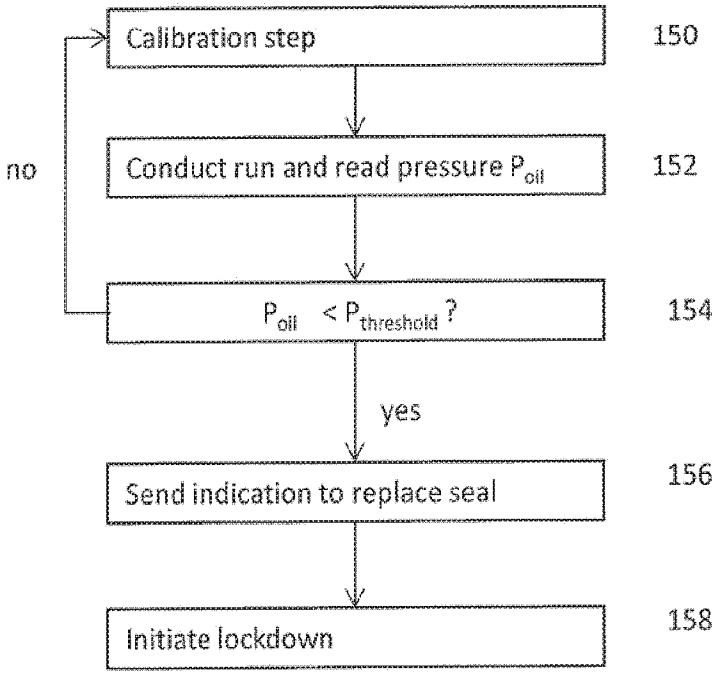
FIG. 23 is a flow chart of steps in a method for predicting seal life failure of the primary seal, as programmed in the controller, according to another embodiment of the invention.

According to another embodiment and referring to FIG. 23, the memory 108 is encoded with program code executable by the controller 106 to carry out a method for predicting remaining life of the primary seal 54 using pressure measurement data taken by the pressure transducer 34.

The primary seal 54 will wear due to rotation from the drive shaft 24 and abrasion from drilling fluid. If the primary seal is not replaced after a certain period of time, the lubrication liquid inside the motor subassembly 25 will leak out. If enough lubrication liquid leaks out, drilling mud can leak in through the worn primary seal 54, which is detrimental to the operation of the motor, bearings and gearbox inside the motor subassembly housing.

The method for predicting primary seal life first comprises a calibration step which involves using the pressure transducer 34 to take a baseline pressure measurement P—baseline of the lubricating oil inside the motor subassembly 25 when the primary seal 54 is new and prior to downhole deployment; this baseline pressure measurement is logged in the memory 108 (step 150). This measurement is taken at surface at a known temperature. The lubricating oil pressure is typically purposely set in an initial assembly step at an overpressure that is slightly higher than atmospheric, i.e. $P_{baseline}>P_{atm}$. The MWD tool 20 is then inserted downhole and deployed in a drilling run; because of the pressure compensation device 32, the pressure of the lubricating oil will equilibrate with the downhole mud pressure (because the lubricating oil is generally incompressible, it is expected that the downhole pressure of the lubricating oil will be slightly higher than the mud pressure by an amount equal to the baseline overpressure).

After the run has been completed the MWD tool 20 is returned to surface, and the controller 106 then executes the next step of the method, which comprises reading the pressure measurement $P_{oil}$ from the pressure transducer 34 (step 152). The pressure measurement at surface can be temperature compensated for accuracy, but this may not be necessary if the threshold pressure has a large safety factor. This measurement is logged in the memory 108, and compared against a threshold pressure value $P_{threshold}$ which represents the lowest acceptable pressure before the primary seal 54 should be replaced (step 154); generally this threshold pressure is set to be slightly higher than atmospheric pressure. The value of $P_{threshold}$ can be set based on an operator's experience or by lab testing of primary seal wear and the lubricating oil pressure at which drilling mud will invade the motor subassembly 25, or by historical data collected from prior runs. If the pressure measurement is at or below $P_{threshold}$ then the controller 106 logs a unique "replace seal" flag in the memory 108 which can be read by an operator when the tool 20 is retrieved at surface using diagnostic equipment (not shown) connected to the controller 106 either wirelessly or by a hard line connection (step 156). Additionally, the controller 106 while downhole or at surface, can be programmed to send a unique "replace seal" signal indicating that the primary seal 54 should be replaced. The signal can be sent in the form of data communicated by a mud pulse telemetry transmission when the tool is downhole, or by some other measureable indicator such as a visual or audible indicator on the tool that can be seen or heard when the tool is retrieved at surface.

Optionally, the controller 106 can initiate a lockdown step (step 158) when the measured pressure $P_{oil}$ falls below the threshold value $P_{threshold}$. The lockdown step can deactivate the MWD tool 20 thereby preventing the tool 20 from being inadvertently used before the primary seal 54 is replaced, and preventing a potential failure.

Figure 24:
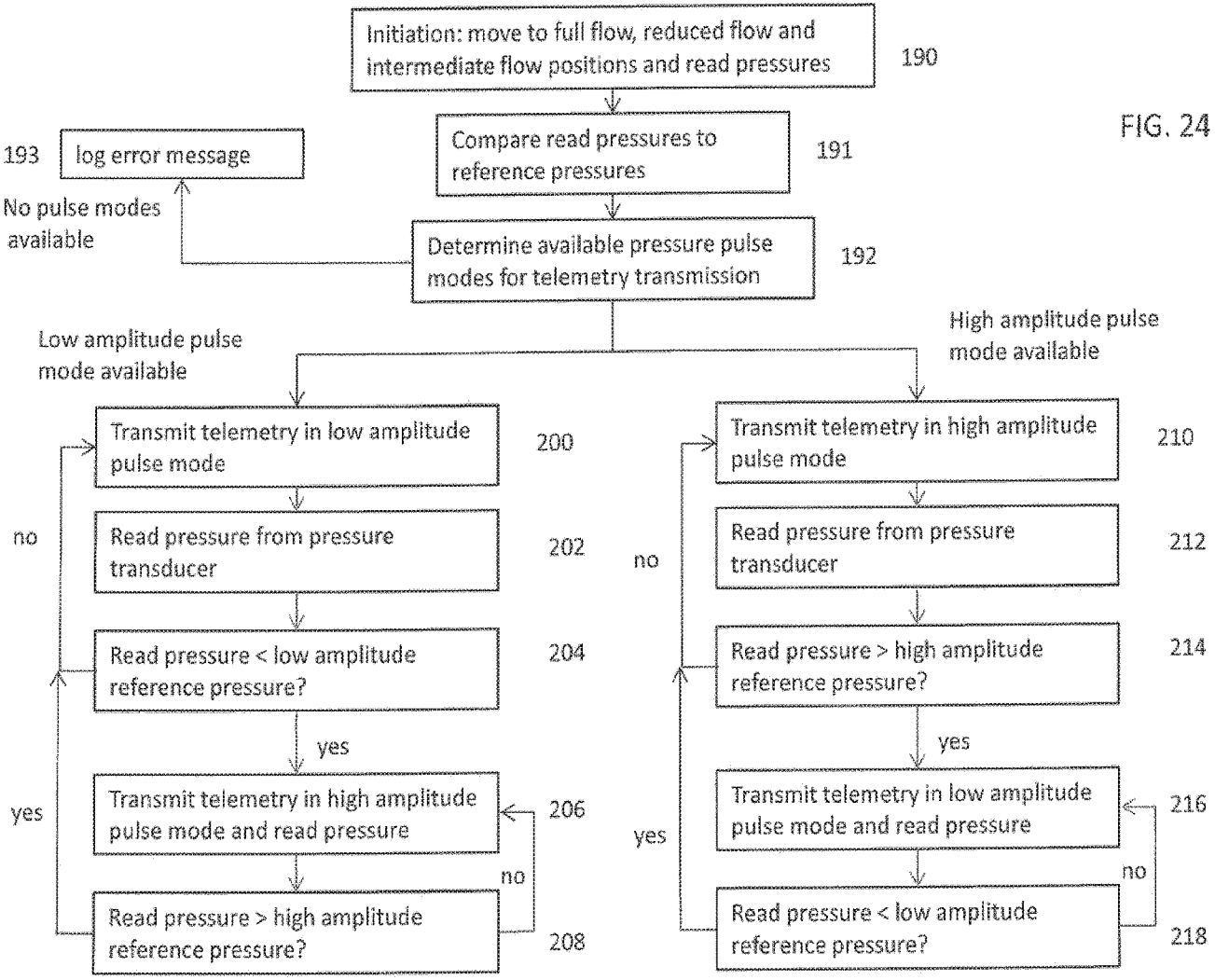
FIG. 24 is a flow chart of steps in a method for controlling pressure pulse amplitude using measurements from the pressure transducer and feed through subassembly, as programmed in the controller, according to another embodiment of the invention.

Method for Controlling Pressure Pulse Amplitude Using Pressure Transducer Measurements According to another embodiment and referring to FIG. 24, the memory 108 is encoded with program code executable by the controller 106 to carry out a method for controlling pressure pulse amplitudes generated by the pulse generator 30 using the pressure measurements from the pressure transducer 34. As will be described below, the pressure measurements are used to determine whether the pulse generator should be operated in a low amplitude pulse mode, or a high amplitude pulse mode, or a combined "normal" mode to transmit telemetry data to surface.

Figure 16:
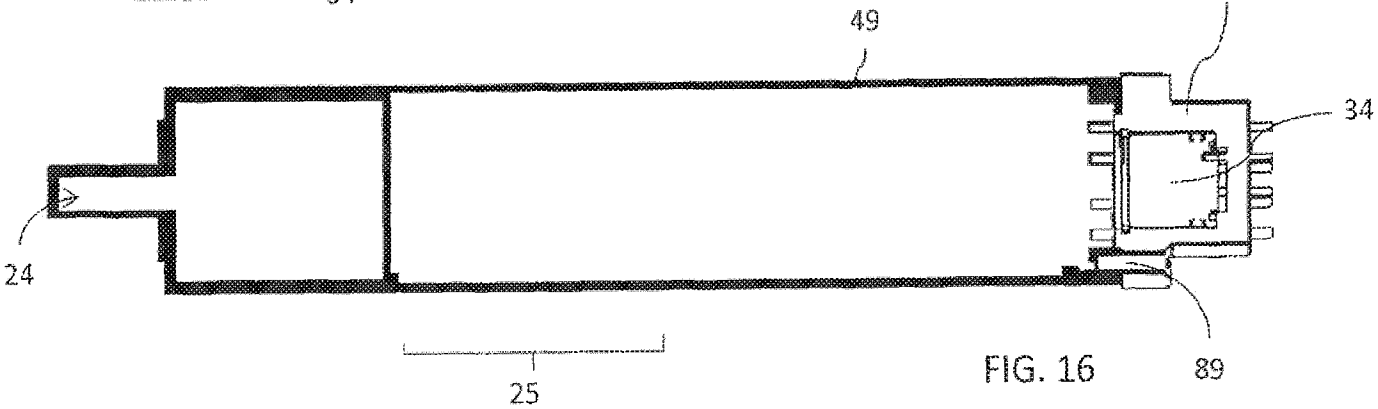
FIG. 16 is a longitudinally sectioned view of the pressure transducer and feed through subassembly shown in FIG. 13 mounted to a motor casing of the motor subassembly.
Figure 18:
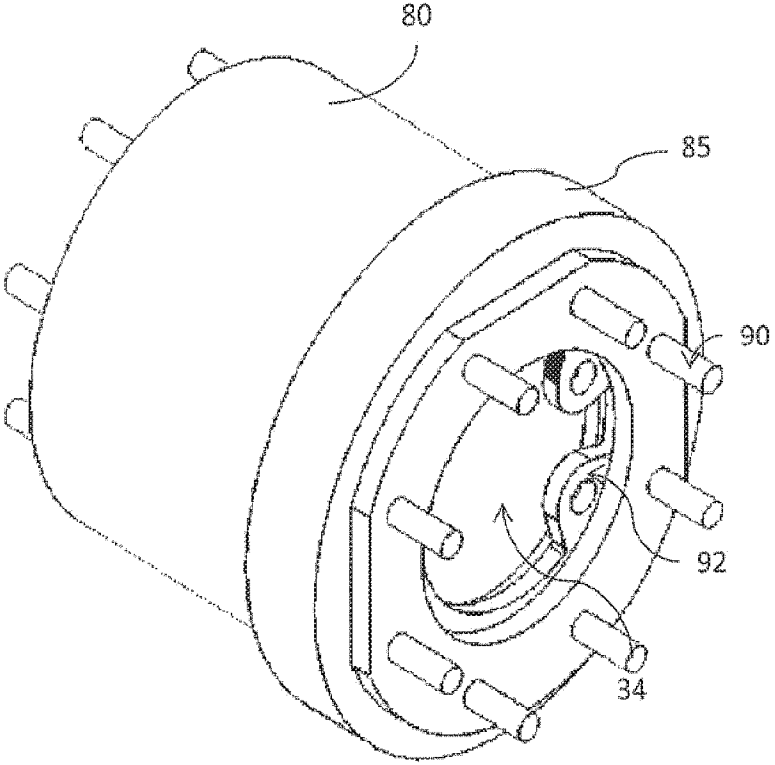
FIG. 18 is a perspective view of a high pressure end of the pressure transducer and feed through subassembly shown in the FIG. 17.
Figure 17:
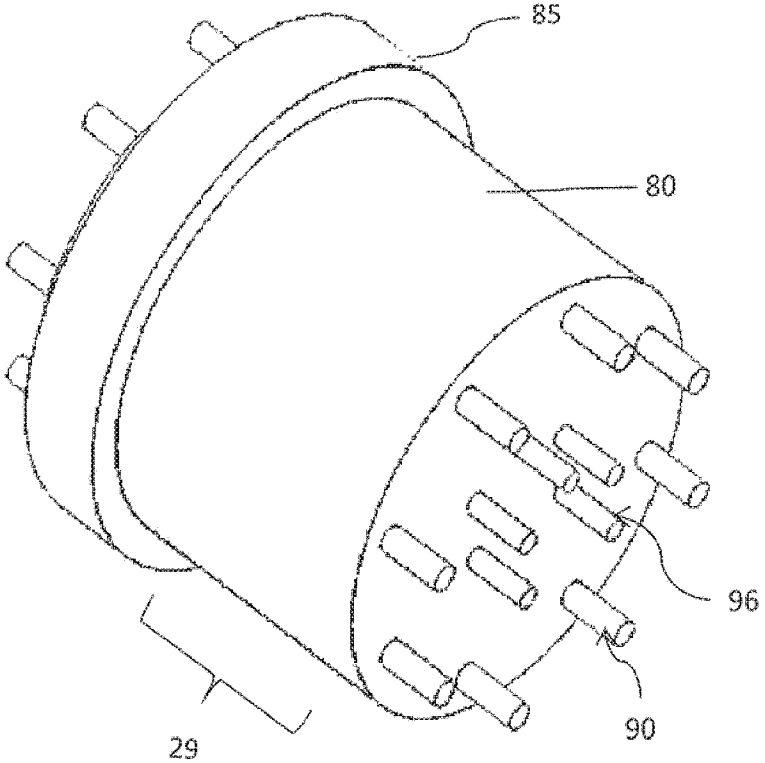
FIG. 17 is a perspective view of a low pressure end of the pressure transducer and feed through subassembly of the MWD tool according to a third embodiment.
Figure 19:
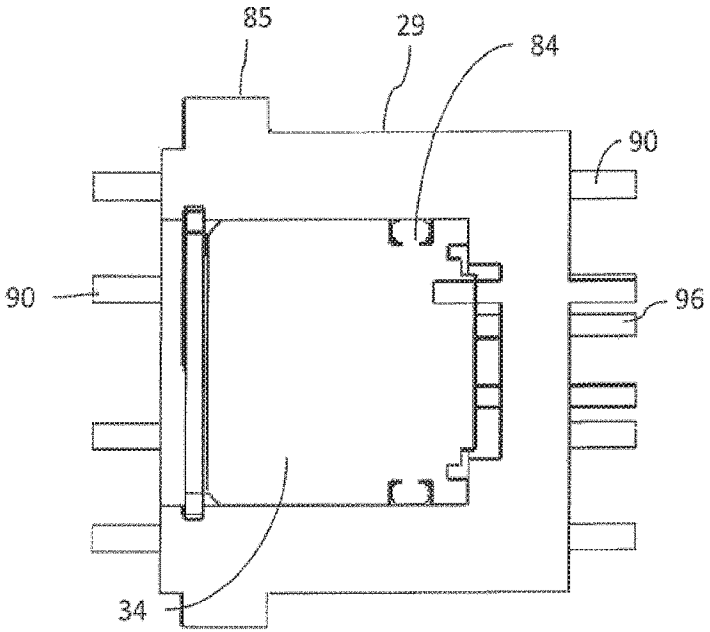
FIG. 19 is a longitudinally sectioned view of the pressure transducer and feed through subassembly shown in FIG. 17.
Figure 20:
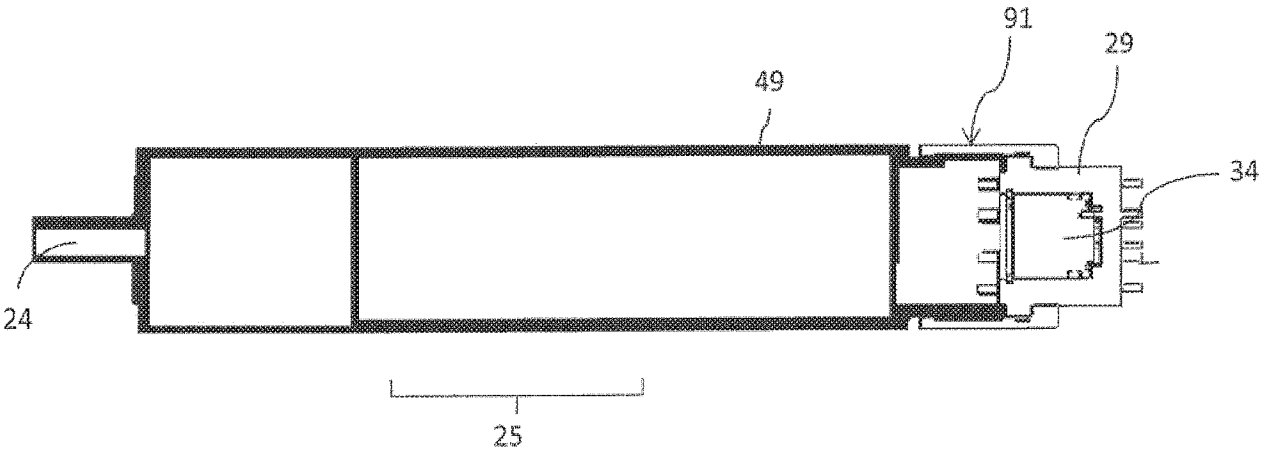
FIG. 20 is a longitudinally sectioned view of the pressure transducer and feed through subassembly shown in FIG. 17 mounted to a motor casing of the motor subassembly.

As noted above, the pulse generator 30 comprises a rotor 60 and stator 40 combination which operates to generate pressure pulses 5, 6. Referring to FIG. 16, the rotor 60 can be rotated relative to the fixed stator 40 to provide three different flow configurations, two of which create pressure pulses of different amplitude ("high and low pulse height states") and one which does not create a pressure pulse ("no-pulse height state"). A high amplitude pressure pulse having a peak measured pressure $P_{high\text{-}pulse}$ (high pulse height state) corresponds to when the pulse generator 30 is in its reduced flow configuration for a selected default time period, a low amplitude pressure pulse having a peak measured pressure $P_{low\text{-}pulse}$ (low pulse height state) corresponds to when the pulse generator 30 is in its intermediate flow configuration for a selected default time period, and the no pressure pulse having a constant measured pressure $P_{no\text{-}pulse}$ (no pulse height state) corresponds to when the pulse generator 30 is in its full flow configuration. The pulse generator 30 can be operated in a high amplitude pulse mode where the pulse generator 30 is moved between the high pulse height state and no pulse height state to generate a carrier wave comprising high amplitude pressure pulses. The pulse generator 30 can also be operated in a low amplitude pulse mode where the pulse generator 30 is moved between the low pulse height state and no pulse height state to generate a carrier wave comprising low amplitude pressure pulses.

The following steps are performed when the controller 106 executes the program for controlling pressure pulse amplitudes. The controller 106 in an initiation step sends a control signal to the pulse generator motor to move the pulse generator 30 into each of the full flow (no pulse height state), intermediate flow (low pulse height state) and reduced flow (high pulse height state) configurations and reads the peak pressures from the pressure transducer 34 in each configuration, namely: $P_{no\text{-}pulse}$ (to obtain a baseline measurement); $P_{low\text{-}pulse}$ and $P_{high\text{-}pulse}$ (step 190). The controller 106 then determines the amplitudes of the pressure pulses in each of the low and high pulse height states by subtracting the read pressure measurements $P_{low\text{-}pulse}$ and $P_{high\text{-}pulse}$ from the baseline measurement $P_{no\text{-}pulse}$. The controller 106 then compares the amplitude of the measured low amplitude pressure pulse $P_{low\text{-}pulse}$ with the amplitude of a low amplitude reference pressure $P_{ref\text{-}low}$ stored in the memory 108; $P_{ref\text{-}low}$ can be selected to represent a sufficient amplitude that is expected to be required for the mud pulse telemetry signal to reach surface and be distinguishable by the surface operator. The controller 106 also compares the amplitude of the measured high amplitude pressure pulse $P_{high\text{-}pulse}$ with the amplitude of a high amplitude reference pressure $P_{ref\text{-}high}$ stored in the memory 108; $P_{ref\text{-}high}$ can be selected to represent an amplitude that is more than sufficient to transmit a telemetry signal to surface, and/or be so strong as to potentially damage or be detrimental to the drilling operation (step 191).

The controller 106 then determines which pressure pulse modes are available to transmit telemetry (step 192), as follows: When the amplitudes of $P_{low\text{-}pulse}$ and $P_{high\text{-}pulse}$ are both greater than the amplitude of $P_{low\text{-}ref}$ and less then than the amplitude of $P_{high\text{-}ref}$ the controller 106 determines that the conditions are suitable to operate the pulse generator 30 in either the high amplitude pulse mode only (steps 200-208) or the low amplitude pulse mode only (steps 210-218). When the amplitude of $P_{low\text{-}pulse}$ is below the amplitude of $P_{low\text{-}ref}$ and when the amplitude of $P_{high\text{-}pulse}$ is greater than the amplitude of $P_{low\text{-}ref}$ but less than the amplitude of $P_{high\text{-}ref}$, the controller 106 allows the pulse generator 30 to start operation only in the high amplitude pulse mode (steps 210 to 218). Conversely, when the amplitude of $P_{high\text{-}pulse}$ is greater than the amplitude of $P_{high\text{-}ref}$ and when the amplitude of $P_{low}$ is higher than the amplitude of $P_{low\text{-}ref}$ and less than the amplitude of $P_{high\text{-}ref}$ the controller 106 allows the pulse generator to start operation only in the low amplitude pulse mode (steps 200-208). When neither of the amplitudes of $P_{low\text{-}pulse}$ and $P_{high\text{-}pulse}$ meet the reference thresholds, then the controller 106 does not allow the pulse generator 30 to operate in any mode, and logs an error message (step 193) onto the memory 108 or optionally sends the error message to surface by some other telemetry transmission means if available, e.g. by electromagnetic or acoustic telemetry if an electromagnetic or acoustic transmitter (neither shown) is part of the drill string.

When the controller 106 allows telemetry transmission in both high and low amplitude pulse modes, the controller can select to start transmitting telemetry in the low amplitude pulse mode. The controller 106 sends control signals to the pulse generator motor to operate the pulse generator 30 between the intermediate and full flow configurations (step 200) to generate a mud pulse telemetry signal. The method of encoding the telemetry data into a form suitable for mud pulse transmission using a single pulse mode is known as modulation and is well known in the art and thus not described in detail here.

While operating in the low amplitude pulse mode, the controller 106 periodically or continuously reads pressure measurements from the pressure transducer 34 (step 202). The controller 106 uses these pressure measurements to determine the amplitude of the low amplitude pressure pulse by subtracting $P_{no\text{-}pulse}$ from $P_{low\text{-}pulse}$. The controller 106 compares the amplitude of the measured low amplitude pressure pulse with the amplitude of the low amplitude reference pressure $P_{low\text{-}ref}$ (step 204). If drilling conditions have changed such that the amplitude of the measured pressure pulse is now below the amplitude of $P_{low\text{-}ref}$, the controller 106 switches to the high amplitude pulse mode by operating the pulse generator 30 between the reduced flow and full flow configurations (step 206); the high amplitude pressure pulse $P_{high\text{-}pulse}$ is designed to be larger in amplitude than the reference amplitude $P_{low\text{-}ref}$ under a design range of operating conditions.

Instead of switching immediately to high-amplitude pulse mode when $P_{low\text{-}pulse}$ is less than $P_{low\text{-}ref}$, the controller 106 can execute an optional step (not shown) to send a control signal to the pulse generator motor to extend the time period the rotor 60 is kept in the intermediate flow configuration during low amplitude pulse mode operation, thereby increasing the amplitude of the pressure pulse until the amplitude is strong enough for the telemetry signal to reach the surface, i.e. is greater than $P_{low\text{-}ref}$. In other words, the pulse generator 30 is held in the intermediate flow configuration for a time period that is longer than the default time period. If the amplitude of the pressure pulse even when operating under this optional step is less than $P_{low\text{-}ref}$, then the controller 106 switches to the high amplitude pulse mode (step 208).

While operating under the high amplitude pulse mode, the controller 106 sends control signals to the pulse generator motor to operate the pulse generator 30 between the reduced and full flow configurations to generate a mud pulse telemetry signal. As noted previously, the method of encoding the telemetry data into a form suitable for mud pulse transmission using a single pulse mode is known as modulation and is well known in the art and thus not described in detail here. The controller 106 continuously or periodically reads pressure measurements data from the pressure transducer 34 (step 206). If the amplitude of the measured pressure pulse is not strong enough even when the pulse generator 30 is operating in the high amplitude pulse mode (i.e. the amplitude of $P_{high\text{-}pulse}$ is less than $P_{low\text{-}ref}$), the controller 106 in an optional step (not shown) can send a control signal to the pulse generator motor to hold the rotor 60 in a reduced flow configuration for an extended time period that is a longer than the default time period (step not shown), thereby increasing the amplitude of the pressure pulse until the amplitude is strong enough to the telemetry signal to reach the surface.

When the pulse generator 30 is operating in the high amplitude pulse mode, the controller 106 compares the amplitude of the measured pressure $P_{high\text{-}pulse}$ to the high amplitude reference pressure $P_{high\text{-}ref}$ (step 208). If the drilling conditions have changed such that the amplitude of $P_{high\text{-}pulse}$ now exceeds $P_{high\text{-}ref}$, then the controller 106 switches back to the low amplitude pulse mode by returning to step 200. If the amplitude of $P_{high\text{-}pulse}$ still remains below $P_{high\text{-}ref}$ then the controller 106 continues to operate the pulse generator 30 in the high amplitude pulse mode (step 206).

When the controller 106 has determined from the initiation step that the pulse generator 30 can be operated in both high and low amplitude pulse modes, the controller 106 can also start telemetry transmission using the high amplitude pulse mode (step 210), and continuously or periodically read pressure measurements from the pressure transducer 34 (step 212). The controller 106 continues to operate the pressure generator 30 in the high amplitude pulse mode so long as the amplitude of $P_{high\text{-}pulse}$ is below $P_{high\text{-}ref}$ and above $P_{low\text{-}ref}$. When the controller 106 determines that the amplitude of $P_{high\text{-}pulse}$ is below $P_{low\text{-}ref}$ the controller in an optional step can hold the rotor 60 in the reduced flow configuration for the extended time period to increase the amplitude of the pressure pulse; if this step is not successful, the controller 106 can switch the pulse generator 30 to operate in the low amplitude pulse mode or stop operation and log an error message in the memory 108. When the controller 106 determines that the amplitude of $P_{high\text{-}pulse}$ exceeds $P_{high\text{-}ref}$ (step 214), the controller 106 will switch the pulse generator 30 to operate in the low amplitude pulse mode (step 216) and continuously or periodically read pressure measurements from the pressure transducer 34 (step 218). The controller 106 will continue to operate the pulse generator 30 in the low amplitude pulse mode until the amplitude of $P_{low\text{-}pulse}$ falls below $P_{low\text{-}ref}$ in which case the controller 106 switches back to operate in the high amplitude pulse mode (step 210).

Instead of arbitrarily starting the pulse generator 30 in the low amplitude or high amplitude pulse modes, the controller 106 can process data taken by the sensors in the MWD telemetry tool 20 or by other sensors in the BHA, to determine the drilling conditions and whether it is more favourable to start the telemetry transmission in the low amplitude or high amplitude pulse modes.

Alternatively, the controller 106 can omit executing the initiation step, and instead start telemetry transmission in one of the low amplitude or high amplitude pulse modes, and then switch to the other pulse mode when the pressure measurements taken during telemetry transmission indicate that the amplitude of the measured pressure pulses do not meet their threshold reference values.

As noted above, the telemetry data can include D&I and drilling condition data measured by the sensors in the MWD tool 20. Part of the telemetry data that is sent to the surface by the pulse generator 30 can also include the amplitudes of the pressure pulses generated by the pulse generator 30. This data can be compared to uphole measurements to determine pulse height losses (i.e. pressure pulses generated versus the pressures measured at surface, etc.); this data can be useful for properly modelling attenuation of pulses under given conditions.

By executing the program that carries out the method for controller pressure pulse amplitude, the MWD tool 20 can be an adaptive tool to flow variable conditions, such as depth, density and flow rate. The method provides a means for checking if the pressure pulse is too high or too low; the latter can cause damage to the rotor 60/stator 40 and lead to cavitation of the drilling mud through the pulse generator 30 because of the excessive pressure drop or change across the MWD tool 20, and the former can cause drive shaft 24 failure by increased tension on the drive shaft 24 or failure of other components such as bearings and keys due to excessive load. Execution of this program is also expected to increase reliability of mud pulse telemetry as the amplitude of the pulse is optimized for transmission to surface, i.e. the method ensures that the pulse amplitude is sufficiently strong to be decoded at surface.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of the general concept.

What is claimed is:

1. A pressure measurement apparatus for a downhole measurement-while-drilling tool, the apparatus comprising:

(a) a feed through connector comprising:

a body with a first end and an opposite second end;

at least one electrical interconnection extending axially through the body and out of the first and second ends; and a pressure transducer receptacle formed within the first end of the body; and a communications bore extending from the receptacle to the second end; and (b) a pressure transducer seated in the receptacle such that a pressure at the first end can be measured, wherein the feed through connector further comprises at least one electrical contact that extends from the pressure transducer through the communications bore and out of the second end.

2. The pressure measurement apparatus as claimed in claim 1, further comprising a receptacle seal extending between the pressure transducer and receptacle and establishing a fluid seal therebetween.

3. The pressure measurement apparatus as claimed in claim 1 wherein the pressure transducer is removably mounted in the receptacle and the apparatus further comprises a retention clip removably mounted in the receptacle for securing the pressure transducer in place when seated in the receptacle.

4. The pressure measurement apparatus of claim 1, wherein the body is pressure rated to withstand up to 38,000 psi.

5. The pressure measurement apparatus of claim 1, wherein the pressure measurement apparatus further comprises an annular flange extending around the body of the feed through connector.

6. The pressure measurement apparatus of claim 5, wherein the annular flange comprises at least one flange bore for receiving a fastener therethrough.

7. The pressure measurement apparatus of claim 6, wherein the body of the feed through connector is provided with at least one open channel aligned with the at least one flange bore such that the fastener can extend along the channel and through the at least one flange bore.

8. The pressure measurement apparatus of claim 5, further comprising a seal located over the annular flange for providing a fluid seal between the feed through connector and a motor housing configured to mate with the annular flange.

9. The pressure measurement apparatus of claim 1, wherein the body of the feed through connector comprises at least one circumferential shoulder and at least one circumferential channel, on which corresponding one or more seals are mounted.

10. The pressure measurement apparatus of claim 1, wherein the pressure transducer receptacle comprises a depth sufficient to allow the pressure transducer to be recessed within the body of the feed through connector.

* * * * *